US008640420B1

(12) United States Patent
Halley

(10) Patent No.: US 8,640,420 B1
(45) Date of Patent: Feb. 4, 2014

(54) PERGOLA SYSTEM

(76) Inventor: Bradford Halley, Columbus, OH (US)

( * ) Notice: Subject to any disclaimer, the term of this patent is extended or adjusted under 35 U.S.C. 154(b) by 47 days.

(21) Appl. No.: 13/177,391

(22) Filed: Jul. 6, 2011

Related U.S. Application Data

(60) Provisional application No. 61/361,657, filed on Jul. 6, 2010.

(51) Int. Cl.
*E04H 12/00* (2006.01)

(52) U.S. Cl.
USPC ..... 52/653.1; 52/650.1

(58) Field of Classification Search
USPC ..... 52/653.1, 650.1, 660, 78, 311.1, 169.9, 52/73, 74
See application file for complete search history.

(56) References Cited

U.S. PATENT DOCUMENTS

| | | | | |
|---|---|---|---|---|
| 5,873,202 | A * | 2/1999 | Parks | 52/73 |
| 6,829,862 | B1 * | 12/2004 | Skulsky | 52/95 |
| 7,900,417 | B1 * | 3/2011 | Leines | 52/650.3 |
| 8,240,097 | B2 * | 8/2012 | Day et al. | 52/298 |
| 2005/0081460 | A1 * | 4/2005 | Davis | 52/169.9 |
| 2005/0257464 | A1 * | 11/2005 | Skulsky | 52/311.1 |
| 2006/0185270 | A1 * | 8/2006 | Handley et al. | 52/169.14 |
| 2007/0227080 | A1 * | 10/2007 | Tseng | 52/78 |
| 2011/0197536 | A1 * | 8/2011 | Clark | 52/650.1 |

OTHER PUBLICATIONS

Internet webpage http://www.backyardamerica.com/vinyl_pergola_comparisons.htm, accessed Jul. 6, 2011.

* cited by examiner

*Primary Examiner* — Mark Wendell
(74) *Attorney, Agent, or Firm* — James R. Eley; Michael E. Forhan; Eley Law Firm Co. LPA

(57) ABSTRACT

A pergola system includes a frame having a plurality of generally vertically-oriented, spaced-apart posts aligned in rows. A generally horizontally-oriented, spaced-apart frame member is attached to each row of posts. A plurality of rails and outer rails extend across the frame members and are oriented generally orthogonally to the frame members, the rails being attached to the frame members. A plurality of purlins extend across the rails outer rails, and are oriented generally orthogonally to the rails and outer rails, the purlins being attached to the rails and outer rails. The pergola system is freestanding.

13 Claims, 36 Drawing Sheets

PERGOLA SYSTEM

This application claims priority to U.S. provisional patent application No. 61/361,657, filed Jul. 6, 2010, the contents of which are hereby incorporated by reference.

FIELD

The present invention relates generally to building structures, in particular, to a pergola system.

BACKGROUND

Pergolas are popular structures and may be found on the lawns of many homes. They may be used to provide full or partial shade or rain protection, allowing for more enjoyable outdoor dining or recreation.

A drawback of current pergolas is that they are typically made from wood materials. Consequently, the wood must be treated or coated to prevent deterioration due to exposure to the elements. The treatment or coating used to protect the wood material must itself be renewed periodically due to the wear-and-tear of being exposed to the elements. As a result, pergolas made from wood materials are relatively expensive and require regular maintenance.

Another drawback of current pergolas is that they are typically custom-built at the point of installation, using raw materials. Consequently, the construction of a pergola is beyond the capability of the typical homeowner, who must hire skilled labor for the task. This places a pergola beyond the means of many homeowners.

SUMMARY

A pergola preferably made from vinyl materials is disclosed according of an embodiment to the present invention. The vinyl materials are weather-resistant and thus do not require regular maintenance. The vinyl materials are also relatively lightweight in comparison to wood materials. In addition, the pergola may be made from pre-fabricated components for installation by a homeowner.

An object of the present invention is a pergola system that includes a frame having a plurality of generally vertically-oriented, spaced-apart posts aligned in rows. A generally horizontally-oriented, spaced-apart frame member is attached to each row of posts. A plurality of rails and outer rails extend across the frame members and are oriented generally orthogonally to the frame members, the rails being attached to the frame members. A plurality of purlins extend across the rails outer rails, and are oriented generally orthogonally to the rails and outer rails, the purlins being attached to the rails and outer rails. The pergola system is freestanding.

In another embodiment, a pergola system includes a plurality of generally vertically-oriented, spaced-apart posts aligned in a row. A generally horizontally-oriented, spaced-apart frame member is attached to the row of posts. A plurality of rails and outer rails extend across the frame member and are oriented generally orthogonally to frame member, the rails and outer rails being attached to the frame member proximate a first end of each rail. A building structure attachment bracket is attached to a second, opposing end of each rail and outer rail. A plurality of purlins extend across the rails and outer rails and are oriented generally orthogonally to the rails and outer rails, the purlins being attached to the rails and outer rails. The pergola system is attachable to a building structure with the building structure attachment brackets.

In yet another embodiment of the present invention a pergola system, includes a frame having a plurality of generally vertically-oriented, spaced-apart posts aligned in rows. A pair of spaced-apart, generally horizontally-oriented frame members are attached to each row of posts, each pair of frame members being attached to opposing sides of the posts in a row. A pair of spaced-apart, generally horizontally-oriented outer rails extend generally orthogonally across the frame members, the outer rails being attached to opposing sides of a post of each row. The outer rails and a plurality of rails extend generally orthogonally across the frame members, the rails and outer rails being attached to the frame members. A plurality of purlins extend generally orthogonally across the rails and the outer rails, the purlins being attached to the rails and outer rails. The pergola system is freestanding.

In yet another embodiment of the present invention a pergola system includes a frame having a plurality of generally vertically-oriented, spaced-apart posts aligned in a row. A pair of spaced-apart, generally horizontally-oriented frame members are attached to opposing sides of the row of posts. A pair of spaced-apart, generally horizontally-oriented outer rails are attached to opposing sides of each post, the outer rails extending generally orthogonally across the frame members. A plurality of rails and outer rails extend generally orthogonally across the frame members, the rails being attached to the frame members proximate a first end of each rail. A building structure attachment bracket is attached to a second, opposing end of each outer rail and rail. A plurality of purlins extend generally orthogonally across the outer rails and the rails, the purlins being attached to the rails. The pergola system is attachable to a building structure with the building structure attachment brackets.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION

Figure 1:
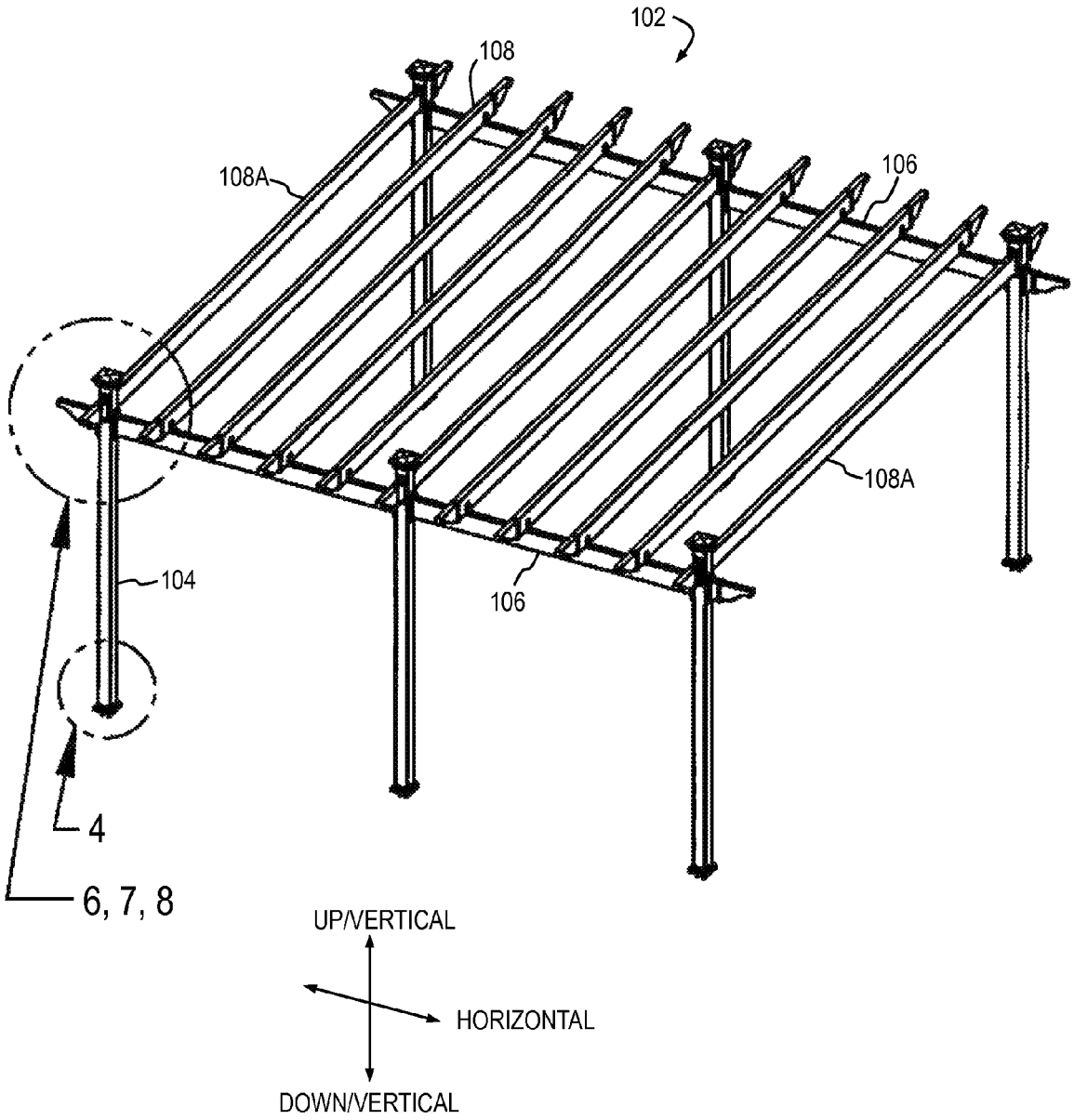
FIG. 1 is a perspective view showing a frame of a freestanding pergola system according to an embodiment of the present invention.
Figure 2:
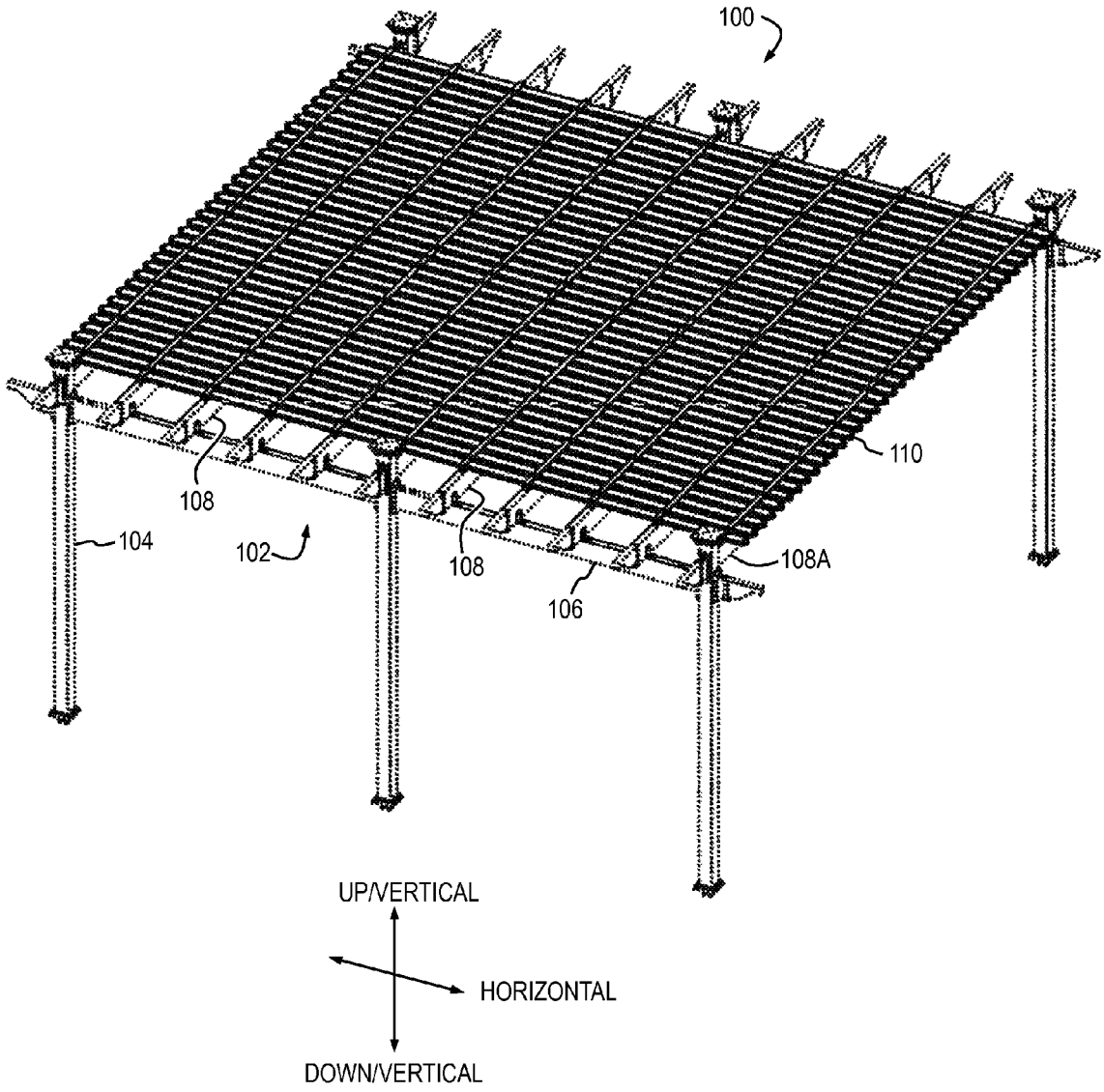
FIG. 2 shows a plurality of purlins coupled to the frame of FIG. 1.

The general arrangement of a freestanding pergola system 100 is shown in FIGS. 1 through 12 according to an embodiment of the present invention. With reference to FIG. 1, system 100 comprises a frame 102 having a plurality of generally vertically-oriented, spaced-apart posts 104 that are aligned in rows. A generally horizontally-oriented, spaced-apart frame member 106 is attached to each row of posts 104. A plurality of rails 108 extend across frame members 106 and are attached to the frame members in a manner discussed in more detail below. Preferably, rails 108 are oriented generally orthogonally to frame members 106. A plurality of purlins 110 extend across rails 108 and are attached to the rails as shown in FIG. 2. Preferably, purlins 110 are oriented generally orthogonally to rails 108 in a manner discussed in more detail below. The general arrangement of an assembled pergola system 100 is shown in FIG. 2.

Figure 3:
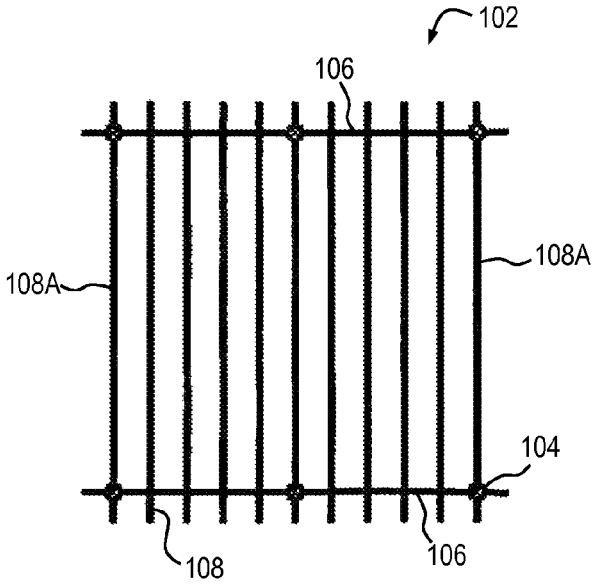
FIG. 3 is a schematic plan view showing the relative spacing of frame members and purlins of the assembly of FIG. 2.

FIG. 3 is a schematic plan view of frame 102. In one embodiment of the present invention frame members 106 are spaced about sixteen feet apart from each other. Likewise, outer rails, indicated in FIGS. 1 and 3 as "108A," are spaced about sixteen feet apart from each other, with a plurality of rails 108 being generally evenly spaced therebetween and attached to frame members 106 in a manner discussed in more detail below. The foregoing dimensions describe an exemplary frame 102 of a pergola system 100 but are not intended to be limiting in any way, as one skilled in the art will appreciate that these dimensions may be varied to suit a particular installation.

Figure 4:
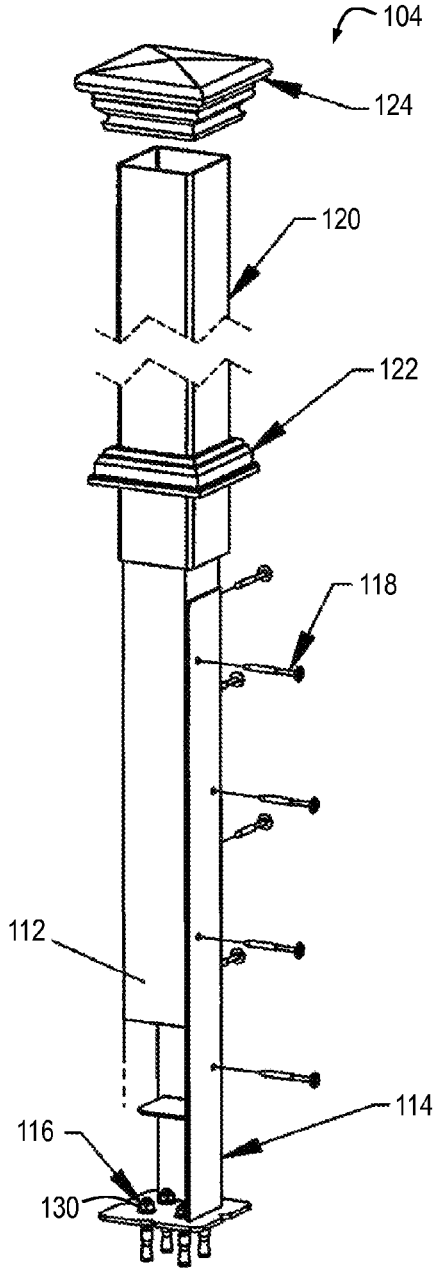
FIG. 4 is an exploded view of a post of the frame of FIG. 1.

FIG. 4 shows details of an example post 104 of system 100. In one embodiment post 104 comprises a support member 112, such as standard "4×4" treated lumber of a suitable length. A post bracket 114 includes a set of anchor bolts 116 and is sized and shaped to receive support member 112. Attachment hardware 118, such as bolts and screws, is utilized to join support member 112 to post bracket 114. A hollow post sleeve 120 fits slidably over the assembled support member 112 and post bracket 114. Decorative items such as a dress skirt 122 and a post cap 124 may be added to post 104, if desired.

Figure 5:
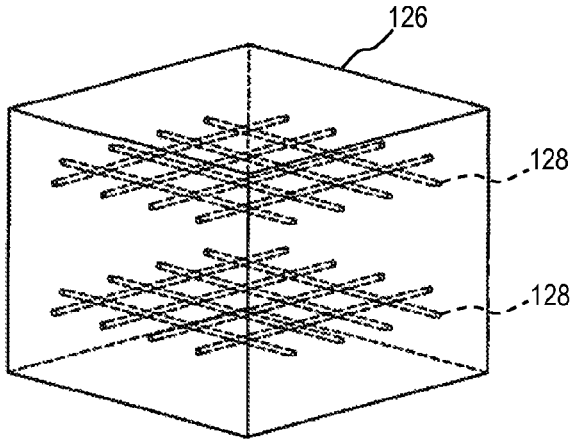
FIG. 5 shows a footing usable with the post of FIG. 4.

A footing space 126, shown in FIG. 5, is one example of a means which may be used at an installation site for system 100 to secure post 104. Footing 126 may be made from concrete of a suitable mass, such as about 30 inches square and about 24 inches in height, although other dimensions are contemplated within the scope of the invention. Reinforcing steel 128 may be embedded in footing 126 to increase the structural integrity of the footing. Alternatively, post 104 may be anchored to a suitable concrete slab. Anchor bolts 116 (FIG. 4) are preferably joined to or embedded in footing 126, post 104 being attached to the anchor bolts with a set of nuts 130 configured to be threadably coupled to the anchor bolts.

Figure 6:
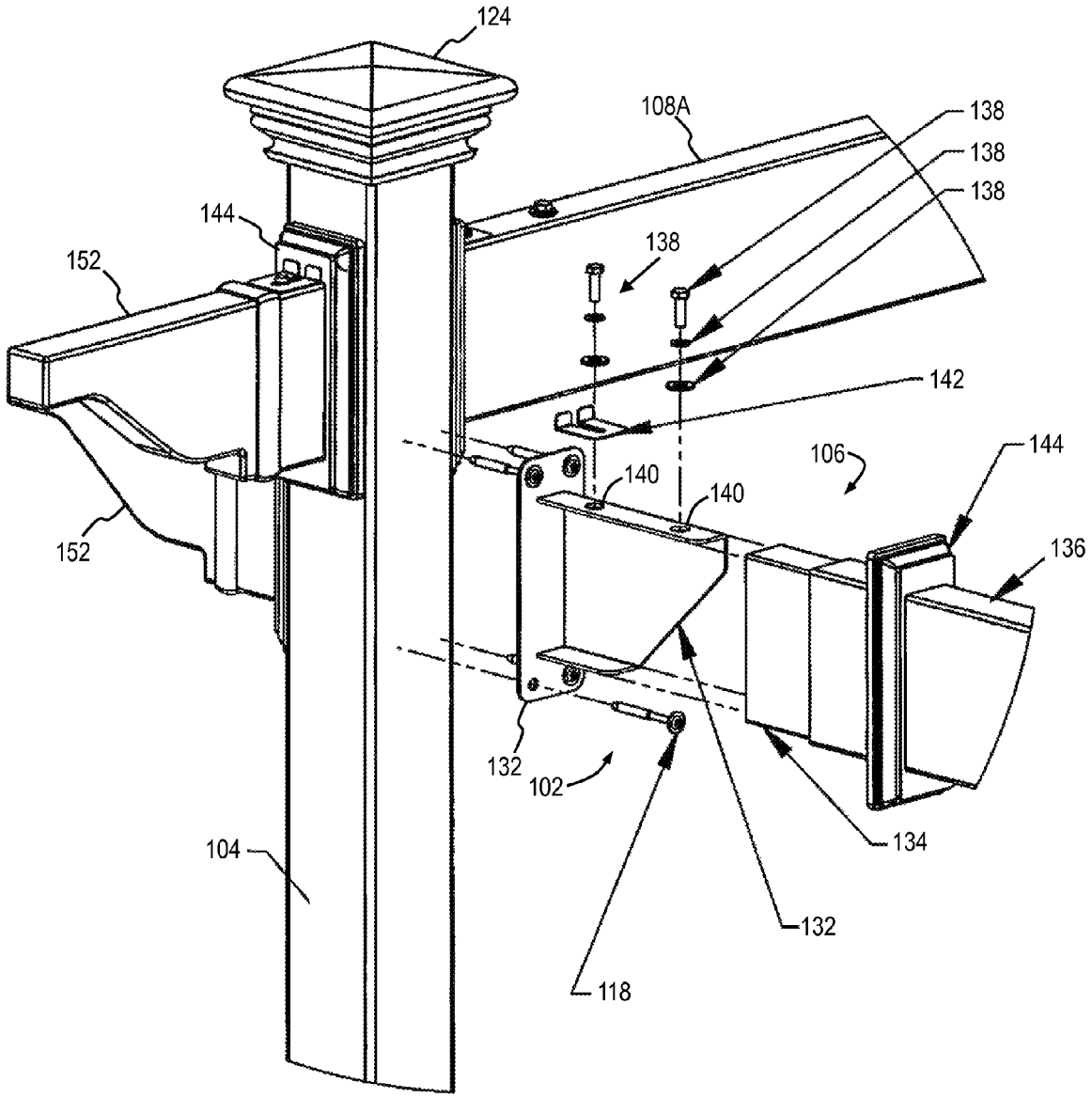
FIG. 6 shows details of the assembly of the frame of FIG. 1.

Details of the assembly of frame 102 are shown in FIG. 6 according to an embodiment of the present invention. A corner bracket 132 is attached to post 104 with hardware 118. Frame member 106 includes a hollow connector portion 134 at each end that slidably engages a corresponding corner bracket 132. A hollow frame sleeve 136 fits slidably over frame member 106. Connector portion 134 of the frame member is coupled to corner bracket 132 with bracket hardware 138, which may include bolts, flat washers and lock washers. Bracket hardware 138 may also include nuts (not shown) to threadably engage the bolts. Alternatively, corner bracket 132 may include threaded apertures 140 to receive the bolts of bracket hardware 138. A fascia retainer 142 is secured to corner bracket 132 by bracket hardware 138 and engages a fascia 144 that is slidably coupled to frame sleeve 136, thereby retaining the fascia to post 104.

Figure 7:
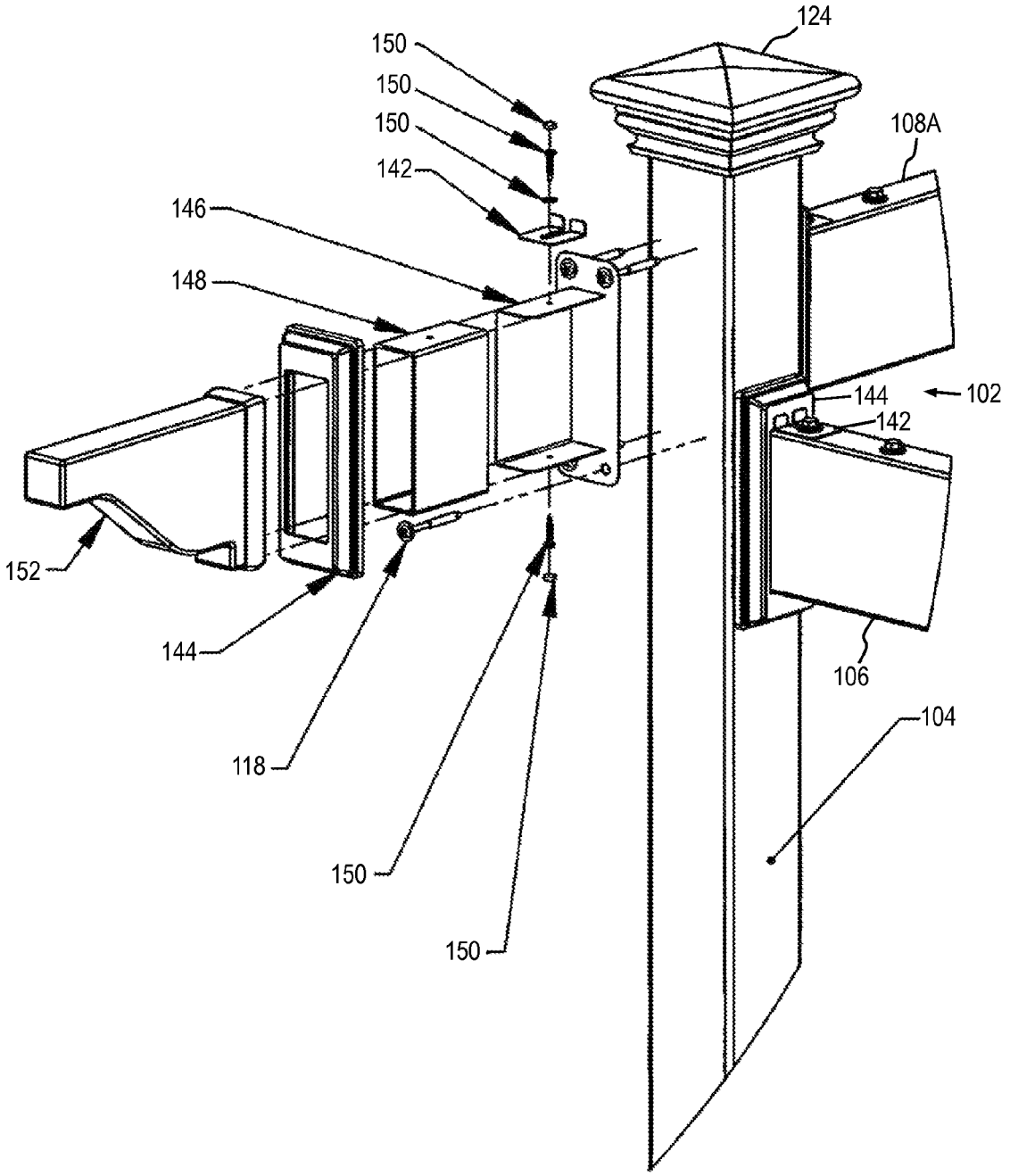
FIG. 7 shows details of the assembly of decorative elements to the frame of FIG. 1.

Details of the assembly of a decorative portion of outer rail 108A to frame 102 are shown in FIG. 7 according to an embodiment of the present invention. A decorative bracket 146 is attached to post 104 with hardware 118. A decorative sleeve 148 slidably engages decorative bracket 146 and is coupled to the decorative bracket with decorative hardware 150, which may include a self-tapping screw, a flat washer, and a screw cap. A fascia retainer 142 is also secured to decorative bracket 146 by decorative hardware 150. A fascia 144 is moved slidably over the decorative sleeve 148 and is coupled to fascia retainer 142, thereby retaining the fascia to post 104. A decorative end 152 is slidably coupled over decorative sleeve 148 and coupled to the assembled bracket 146 and sleeve 148 in any suitable manner, such as with hardware and adhesive. Additional decorative ends 152 may be similarly attached to post 104 proximate frame members 106, as shown in FIG. 6.

Figure 8:
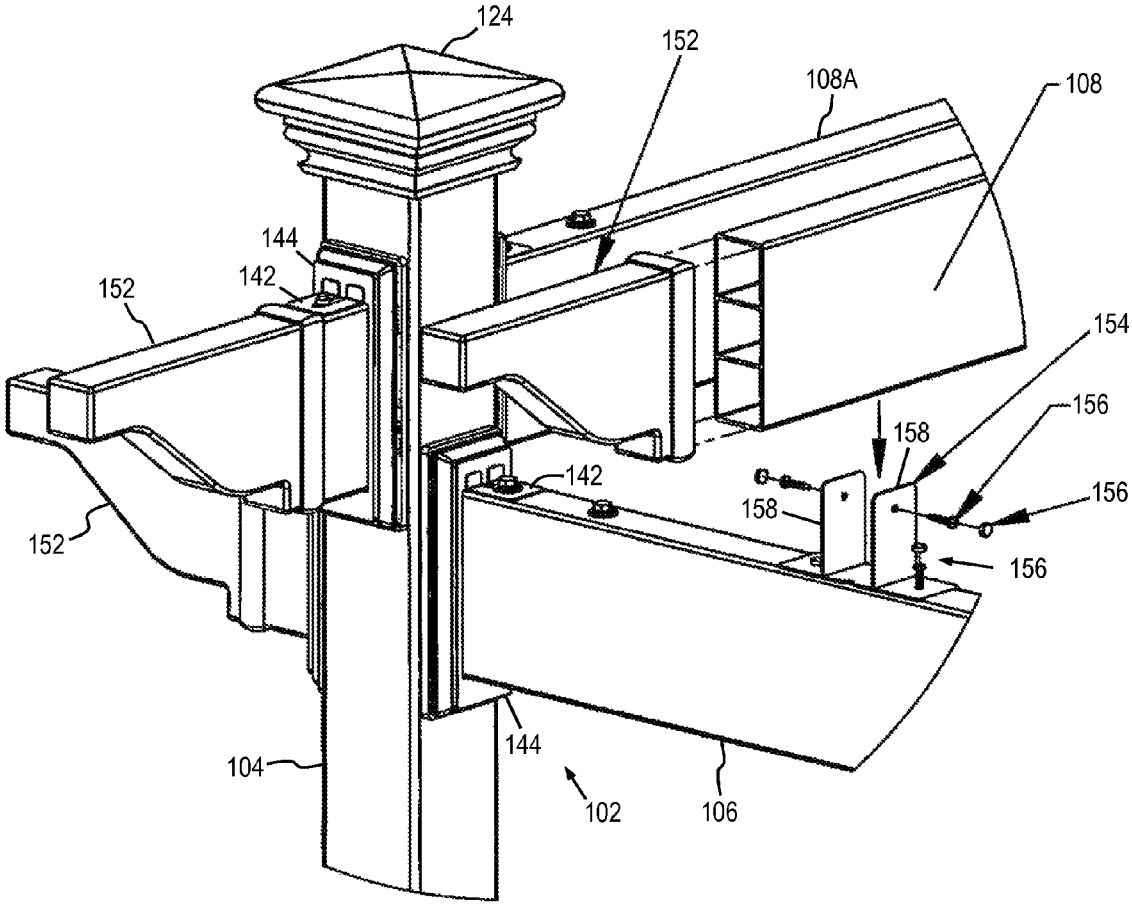
FIG. 8 shows details of the assembly of multiple rails to the frame of FIG. 1.

Details of the assembly of a rail 108 to frame 102 are shown in FIG. 8 according to an embodiment of the present invention. A rail bracket 154 is attached to frame member 106 with rail attachment hardware 156, which may include screws or bolts and screw caps. A rail 108 is positioned between a pair of spaced-apart tabs 158 of rail bracket 154, and is secured to the rail bracket with rail attachment hardware 156. A decorative end 152 is slidably coupled to the end of rail 108 and is secured in any suitable manner such as, but not limited to, rail attachment hardware 156 and adhesive. Outer rails 108A are attached to posts 104 in a similar manner, as can be seen in FIGS. 6-8.

Figure 9:
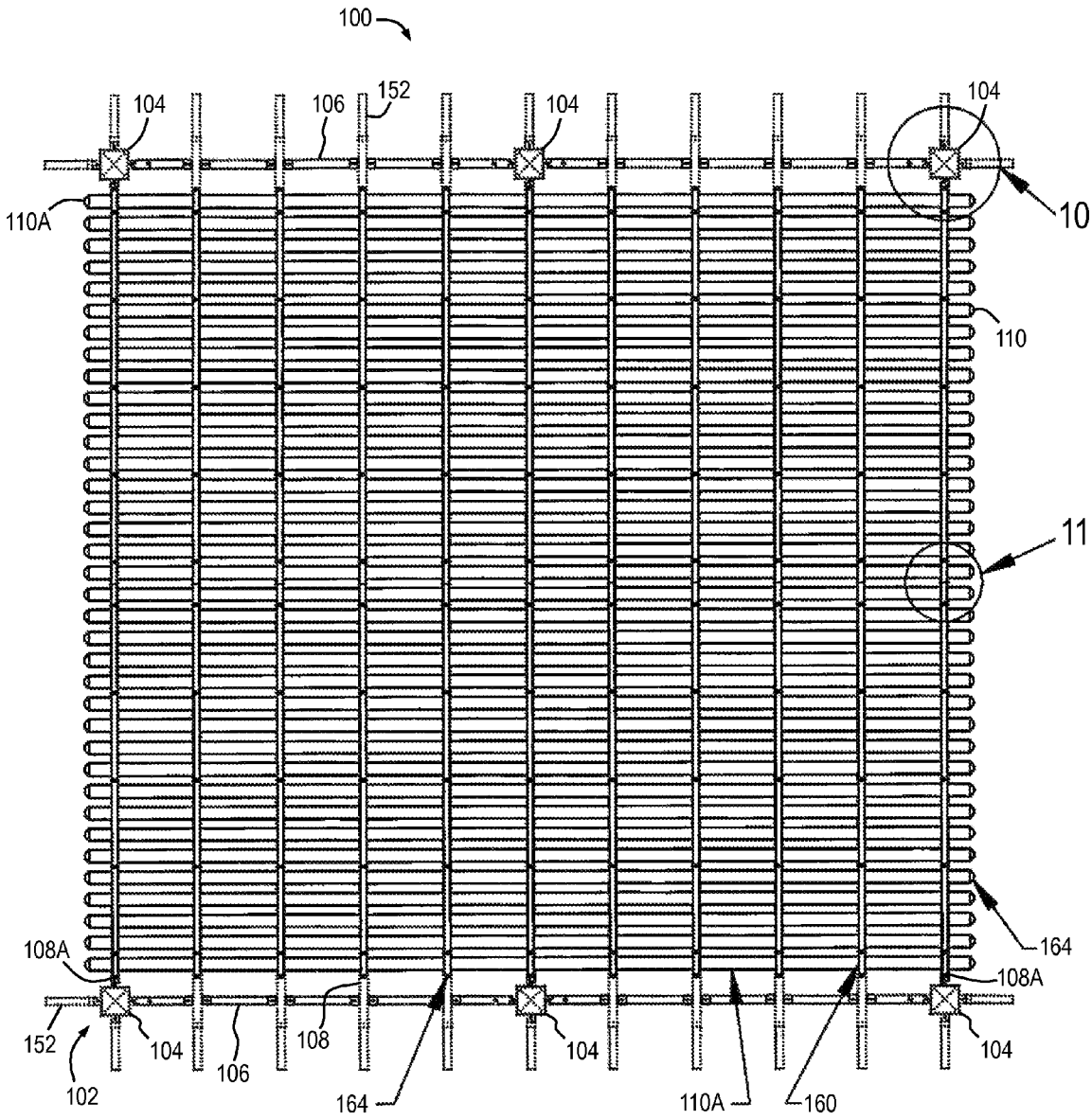
FIG. 9 is a plan view of a freestanding pergola system according to an embodiment of the present invention.
Figure 10:
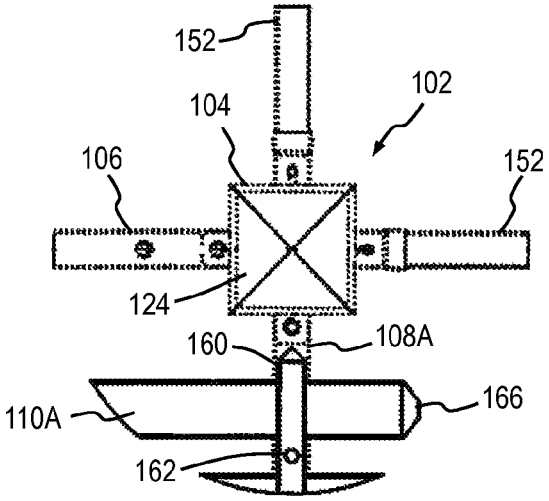
FIGS. 10, 11 and 12 show details of the attachment of purlins to the pergola system of FIG. 9.
Figure 11:
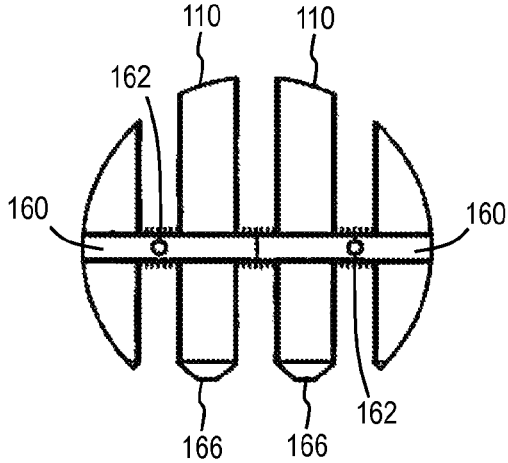
Figure 12:
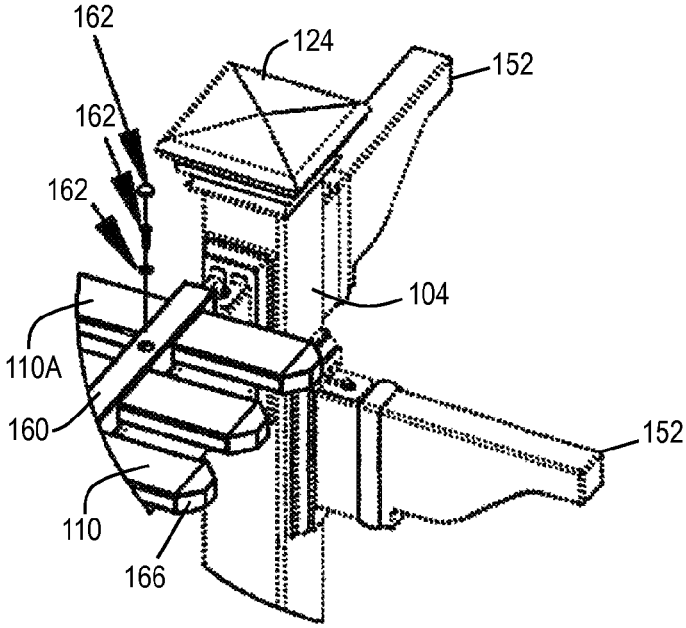

Details of the assembly of purlins 110 to frame 102 are shown in FIGS. 9 through 12 according to an embodiment of the present invention. Purlins 110 are placed atop rails 108, 108A and arranged as generally shown in FIG. 9. Purlins 110 are then secured to rails 108, 108A with purlin mounts 160 that fit over the purlins, the purlin mounts being coupled to rails 108, 108A with purlin mounting hardware 162. Purlin mounting hardware 162 may include self-tapping screws, washers and screw covers. Purlin rail caps 164 are coupled to outer purlins, indicated in FIGS. 9 and 10 as 110A. In addition, purlin caps 166 are coupled to purlins 110, 110A to close off the ends of the purlins.

Preferably, many of the components of system 100 are made from weather-resistant materials such as plastic or composites, including polyvinyl chloride (PVC). Such components include, without limitation, rails 108, 108A, purlins 110, 110A, post sleeve 120, dress skirt 122, post cap 124, frame sleeve 136, decorative sleeve 148, decorative end 152, purlin mounts 160, purlin rail caps 164 and purlin caps 166. In some embodiments some or all of frame members 106, rails 108, 108A and purlins 110 may have an extruded core made from any combination of metal, plastic and composite material, with or without an exterior covering of plastic such as PVC. Alternatively, some or all of frame members 106, rails 108, 108A and purlins 110 may be made as integral pieces from any of metal, plastic and composite material.

In one embodiment of the present invention the various components of pergola system 100 are supplied in kit form with pre-fabricated and pre-cut components. The components may further be provided with openings for the insertion of hardware, for further ease of assembly. Such a pergola system is easily installed by the average homeowner with commonly available tools.

Figure 13:
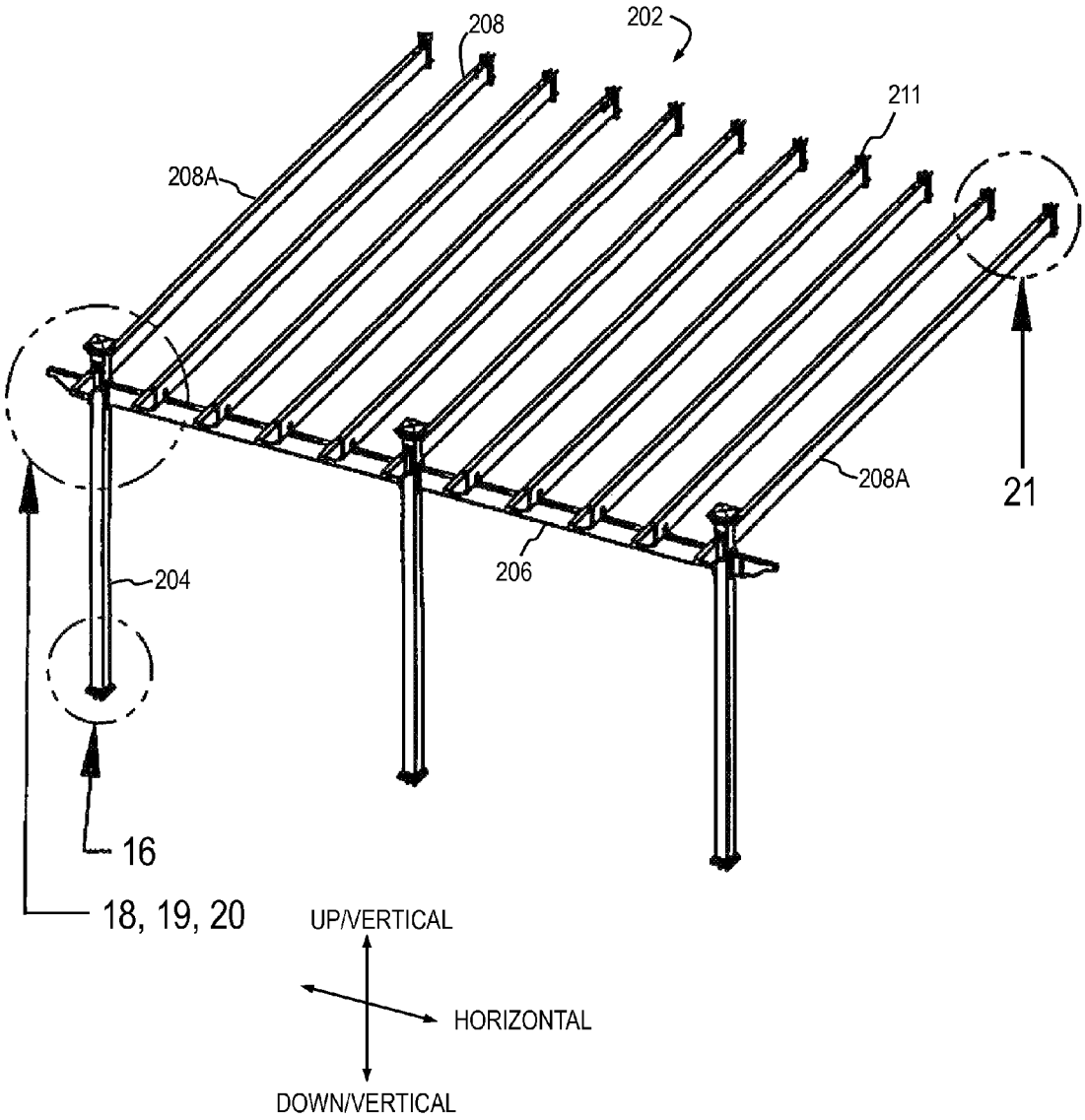
FIG. 13 is a perspective view showing a frame of a pergola system attachable to a building structure according to another embodiment of the present invention.
Figure 14:
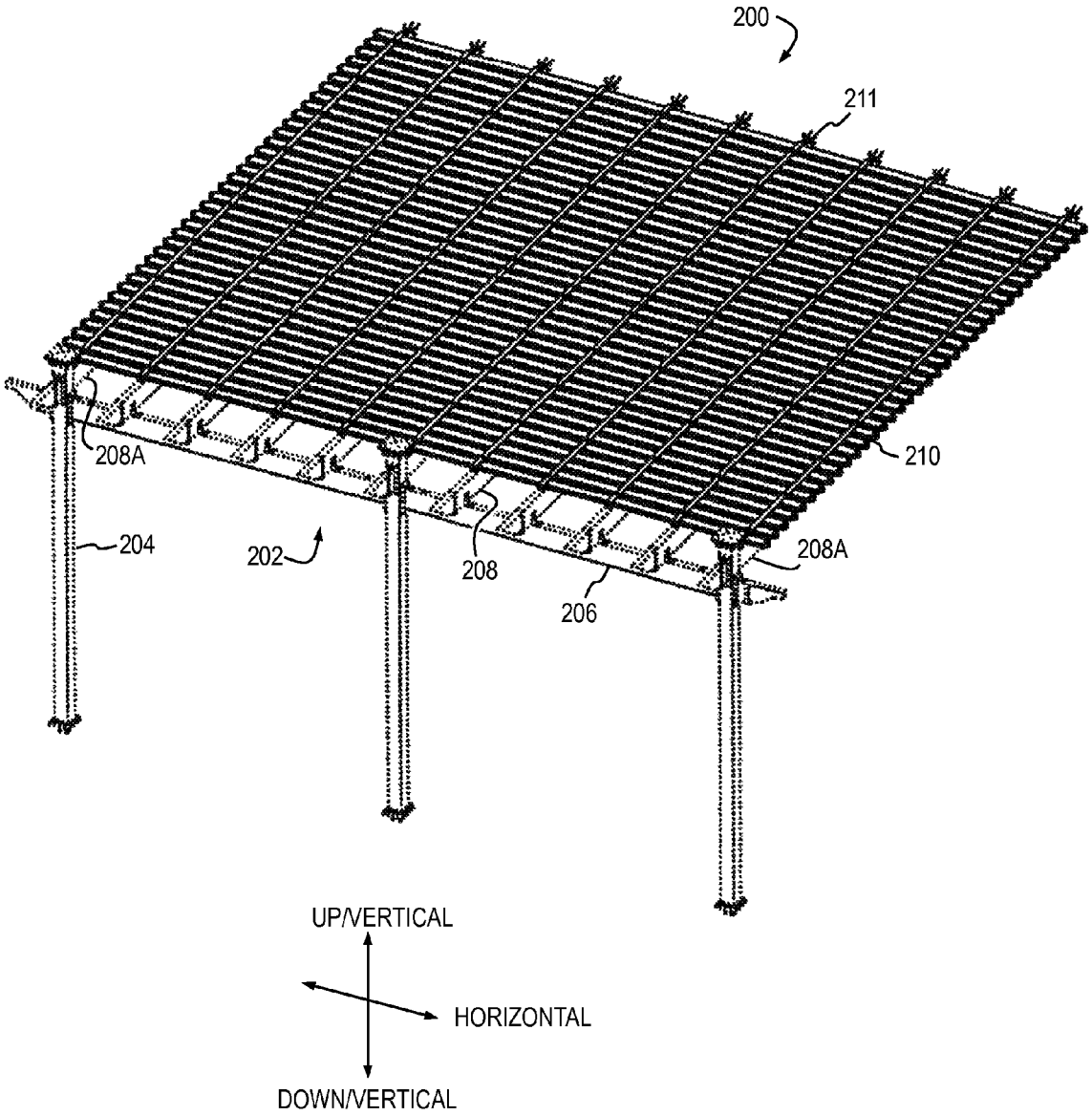
FIG. 14 shows a plurality of purlins coupled to the frame of FIG. 13.

The general arrangement of a pergola system 200 attachable to a building structure is shown in FIGS. 13 through 25 according to an embodiment of the present invention. With reference to FIG. 13, system 200 comprises a frame 202 having a plurality of generally vertically-oriented, spaced-apart posts 204 that are aligned in a row. A generally horizontally-oriented, spaced-apart frame member 206 is attached to the row of posts 204. A plurality of rails 208 extend across frame member 206 and are attached to the frame member in a manner discussed in more detail below. Preferably, rails 208 are oriented generally orthogonally to frame member 206. A plurality of purlins 210 extend across rails 208 and are attached to the rails in a manner discussed in more detail below. Preferably, purlins 210 are oriented generally orthogonally to rails 208 as shown in FIG. 14. A building structure attachment bracket 211 is coupled to each rail 208 at a first end of the rail, a second, opposing end of the rail being proximate frame member 206 as shown in FIG. 13. The general arrangement of an assembled pergola system 200 is shown in FIG. 14.

Figure 15:
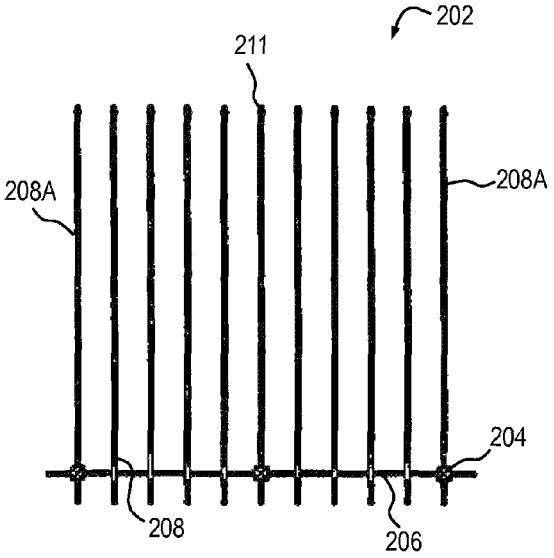
FIG. 15 is a schematic plan view showing the relative spacing of frame members and purlins of the assembly of FIG. 14.

FIG. 15 is a schematic plan view of frame 202. In one embodiment of the present invention frame member 206 is spaced about sixteen feet from apart from building structure attachment bracket 211. Likewise, outer rails indicated in FIGS. 13 and 15 as "208A," are spaced about sixteen feet apart from each other, with a plurality of rails 208 being generally evenly spaced therebetween and attached to frame member 206 in a manner discussed in more detail below. The foregoing dimensions describe an exemplary frame 202 of a pergola system 200 but are not intended to be limiting in any way, as one skilled in the art will appreciate that these dimensions may be varied to suit a particular installation.

Figure 16:
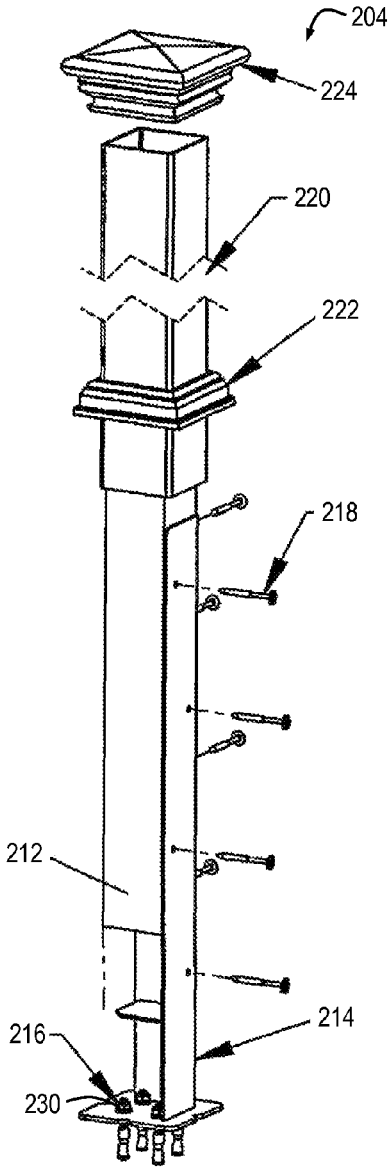
FIG. 16 is an exploded view of a post of the frame of FIG. 13.

FIG. 16 shows details of an example post 204 of system 200. In one embodiment post 204 comprises a support member 212, such as standard "4×4" treated lumber of a suitable length. A post bracket 214 includes a set of anchor bolts 216 and is sized and shaped to receive support member 212. Attachment hardware 218, such as bolts and screws, is utilized to join support member 212 to post bracket 214. A hollow post sleeve 220 fits slidably over the assembled support member 212 and post bracket 214. Decorative items such as a dress skirt 222 and a post cap 224 may be added to post 204, if desired.

Figure 17:
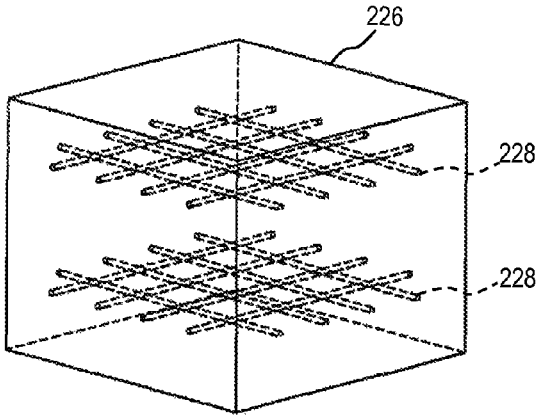
FIG. 17 shows a footing usable with the post of FIG. 16.

A footing space 226, shown in FIG. 17, is one example of a means which may be used at an installation site for system 200 to secure post 204. Footing 226 may be made from concrete of a suitable mass, such as about 30 inches square and about 24 inches in height, although other dimensions are contemplated within the scope of the invention. Reinforcing steel 228 may be embedded in footing 226 to increase the structural integrity of the footing. Alternatively, post 204 may be anchored to a suitable concrete slab. Anchor bolts 216 (FIG. 16) are preferably joined to or embedded in footing 226, post 204 being attached to the anchor bolts with a set of nuts 230 configured to be threadably coupled to the anchor bolts.

Figure 18:
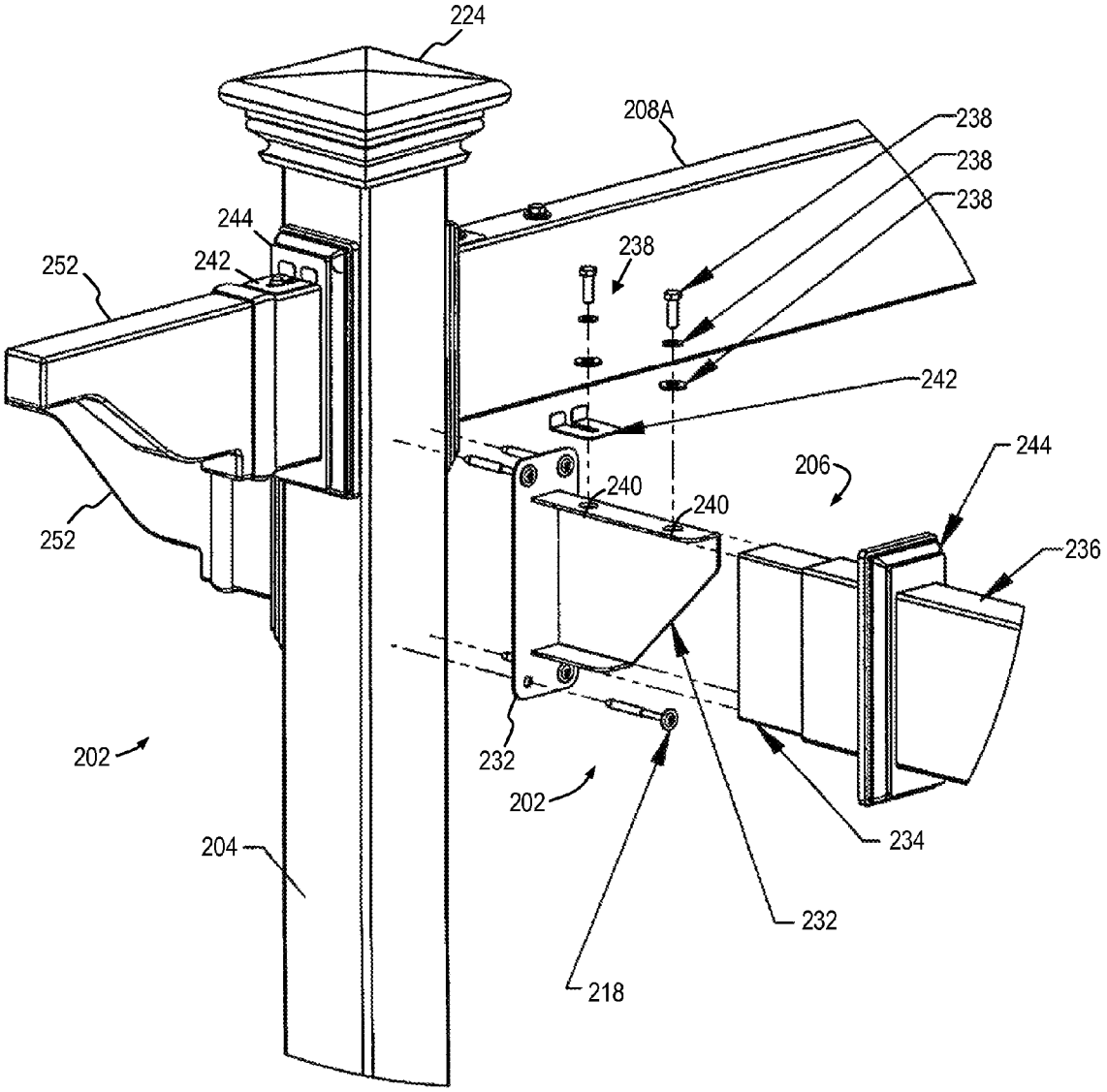
FIG. 18 shows details of the assembly of the frame of FIG. 13.

Details of the assembly of frame 202 are shown in FIG. 18 according to an embodiment of the present invention. A corner bracket 232 is attached to post 204 with hardware 218. Frame member 206 includes a hollow connector portion 234 at each end that slidably engages a corresponding corner bracket 232. A hollow frame sleeve 236 fits slidably over frame member 206. Connector portion 234 of the frame member is coupled to corner bracket 232 with bracket hardware 238, which may include bolts, flat washers and lock washers. Bracket hardware 238 may also include nuts (not shown) to threadably engage the bolts. Alternatively, corner bracket 232 may include threaded apertures 240 to receive the bolts of bracket hardware 238. A fascia retainer 242 is secured to corner bracket 232 by bracket hardware 238 and engages a fascia 244 that is slidably coupled to frame sleeve 236, thereby retaining the fascia to post 204.

Figure 19:
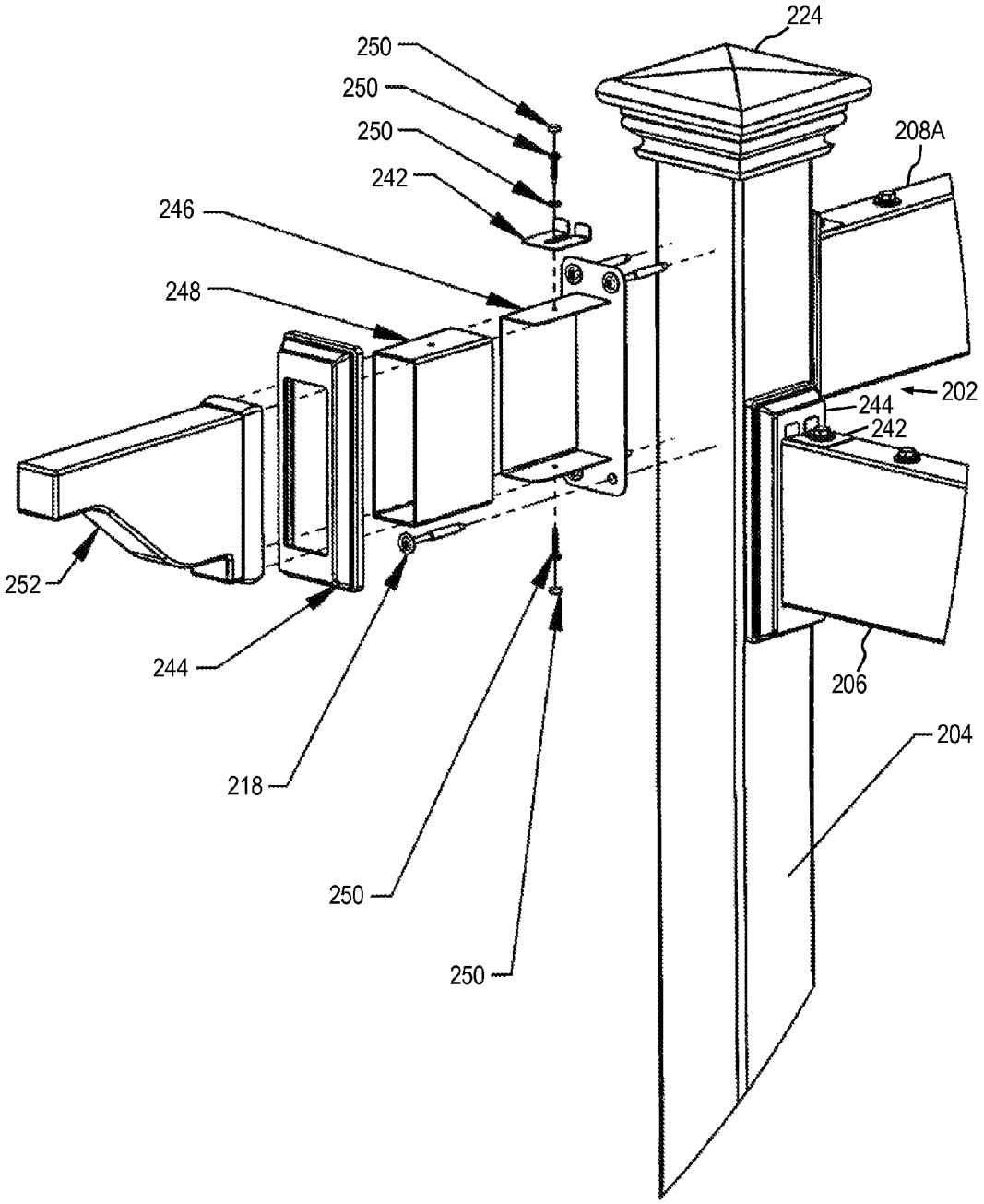
FIG. 19 shows details of the assembly of decorative elements to the frame of FIG. 13.

Details of the assembly of a decorative portion of outer rail 208A to frame 202 are shown in FIG. 19 according to an embodiment of the present invention. A decorative bracket 246 is attached to post 204 with hardware 218. A decorative sleeve 248 slidably engages decorative bracket 246 and is coupled to the decorative bracket with decorative hardware 250, which may include a self-tapping screw, a flat washer, and a screw cap. A fascia retainer 242 is also secured to decorative bracket 246 by decorative hardware 250. A fascia 244 is moved slidably over the decorative sleeve 248 and is coupled to fascia retainer 242, thereby retaining the fascia to post 204. A decorative end 252 is slidably coupled over decorative sleeve 248 and coupled to the assembled bracket 246 and sleeve 248 in any suitable manner, such as with hardware and adhesive. Additional decorative ends 252 may be similarly attached to post 204 proximate frame members 206, as shown in FIG. 18.

Figure 20:
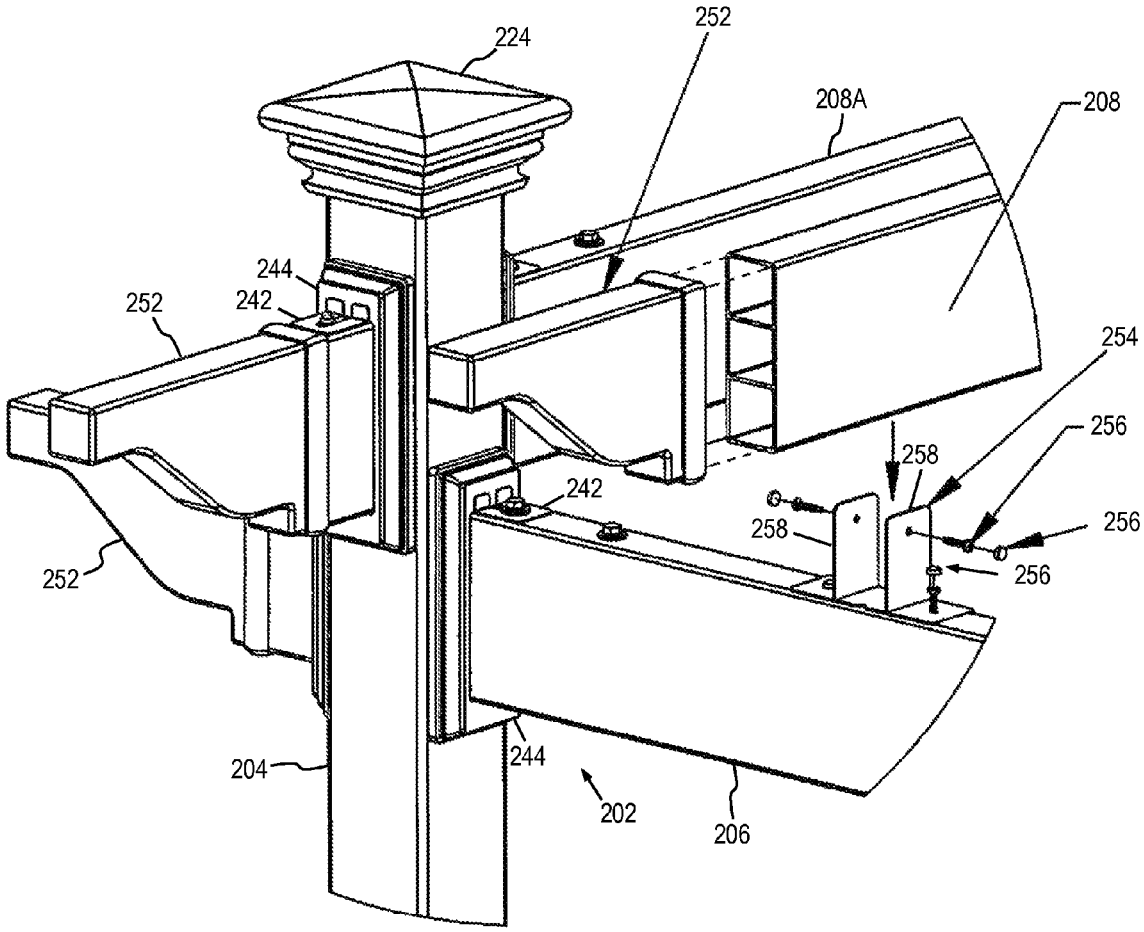
FIG. 20 shows details of the assembly of rails to the frame of FIG. 13.

Details of the assembly of a rail 208 to frame 202 are shown in FIG. 20 according to an embodiment of the present invention. A rail bracket 254 is attached to frame member 206 with rail attachment hardware 256, which may include screws or bolts and screw caps. A rail 208 is positioned between a pair of spaced-apart tabs 258 of rail bracket 254, and is secured to the rail bracket with rail attachment hardware 256. A decorative end 252 is slidably coupled to the end of rail 208 and is secured in any suitable manner such as, but not limited to, rail attachment hardware 256 and adhesive. Outer rails 208A are attached to posts 204 in a similar manner, as can be seen in FIG. 20.

Figure 21:
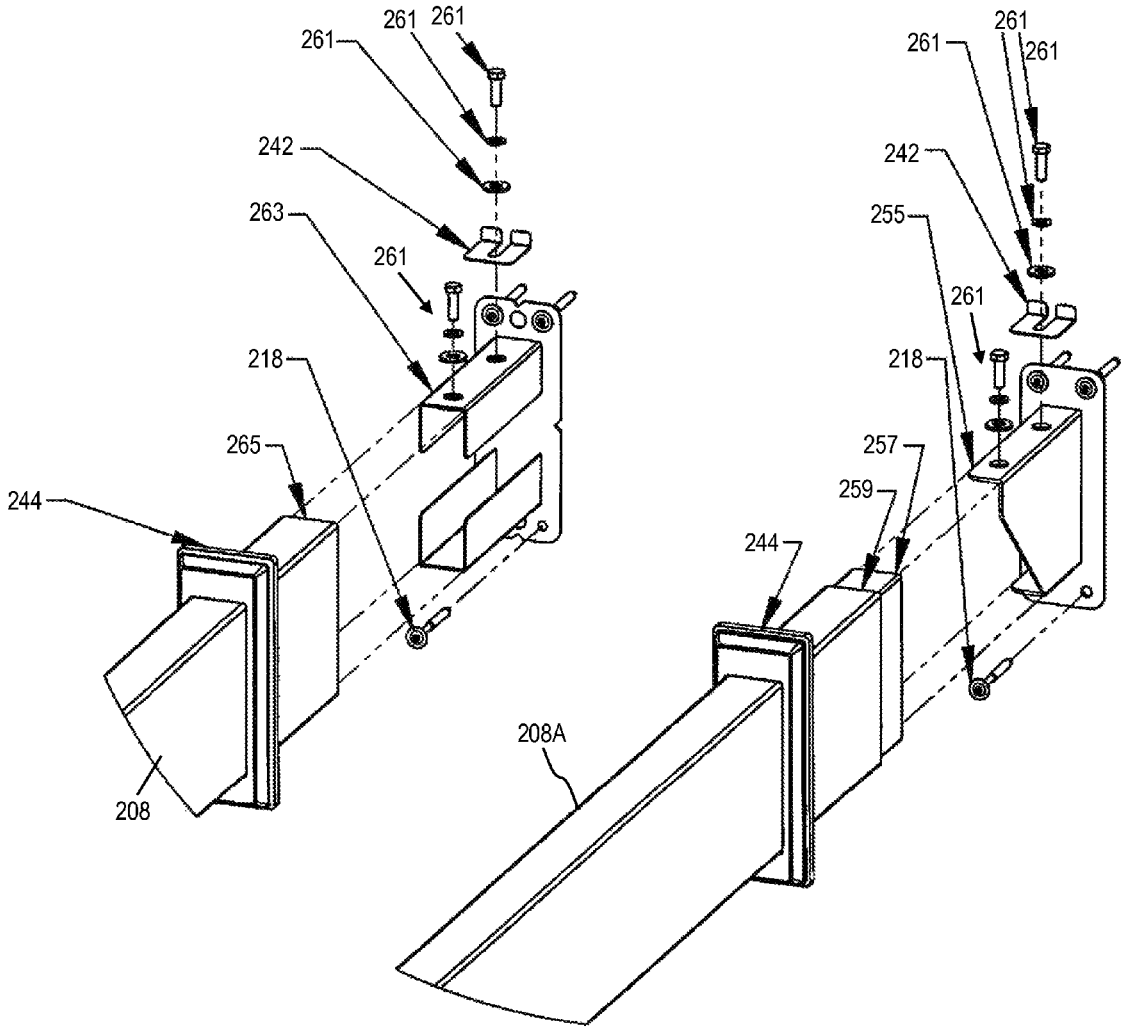
FIG. 21 shows details of portions of the frame of FIG. 13 attachable to a building structure.

FIG. 21 shows details of the assembly of rails 208, 208A to a building structure according to an embodiment of the present invention. A first building attachment bracket 255 is attached to a hollow connector portion 257 and an outer sleeve 259 of outer rail 208A with building attachment bracket hardware 261, which may include screws or bolts and screw caps. A fascia retainer 242 is also secured to outer rail 208A with building attachment bracket hardware 261. A fascia 244 is moved slidably over outer rail 208A and is coupled to fascia retainer 242, thereby retaining the fascia to first building attachment bracket 255. First building attachment bracket 255 is attached to a building structure (not shown) with hardware 218.

Likewise, a second building attachment bracket 263 is attached to a hollow connector portion 265 of rail 208 with building attachment bracket hardware 261. A fascia retainer 242 is also secured to outer rail 208 with building attachment bracket hardware 261. A fascia 244 is moved slidably over outer rail 208 and is coupled to fascia retainer 242, thereby retaining the fascia to second building attachment bracket 263. Second building attachment bracket 263 is attached to a building structure (not shown) with hardware 218.

Figure 22:
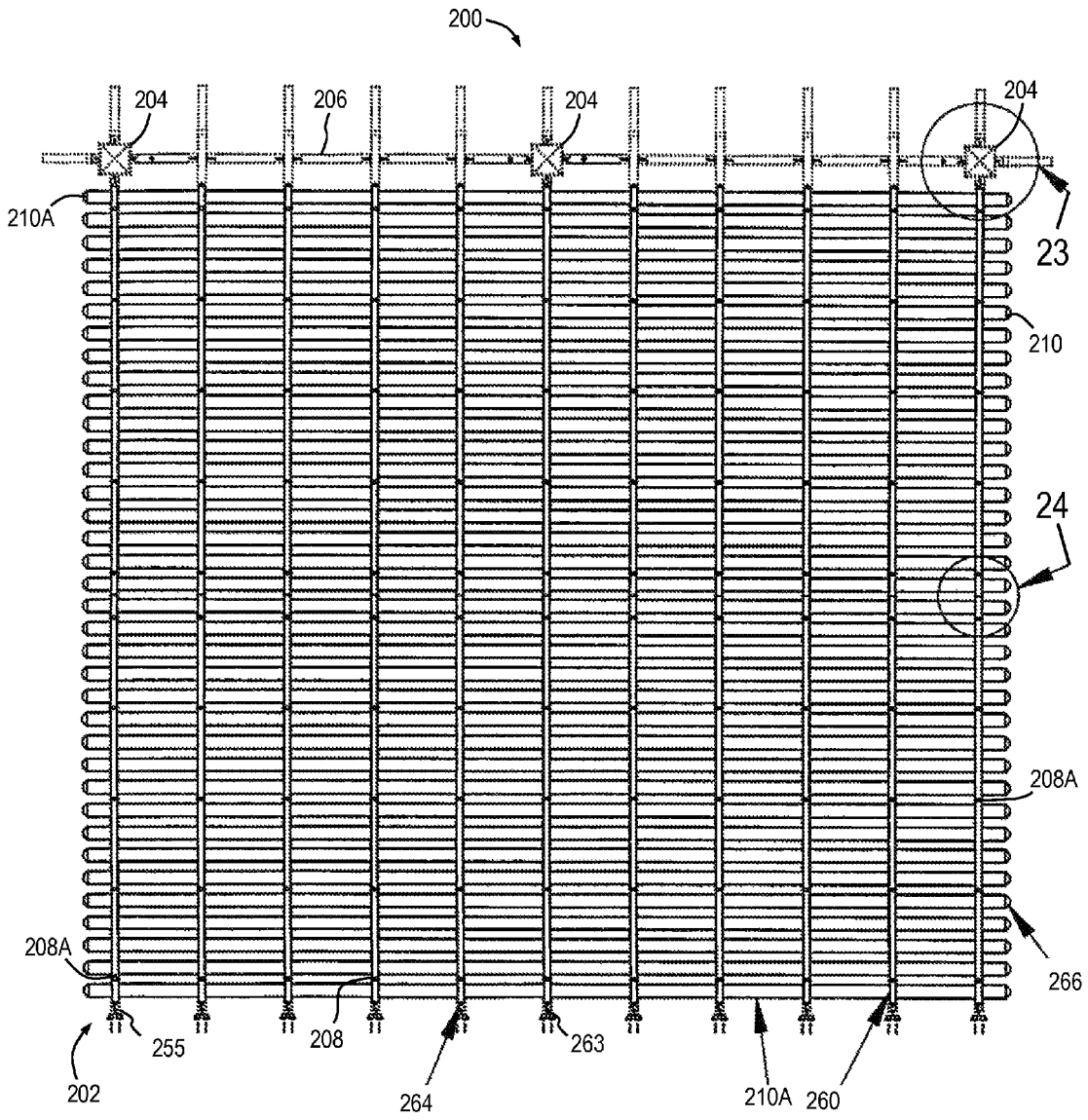
FIG. 22 is a plan view of a pergola system attachable to a building structure according to another embodiment of the present invention.
Figure 23:
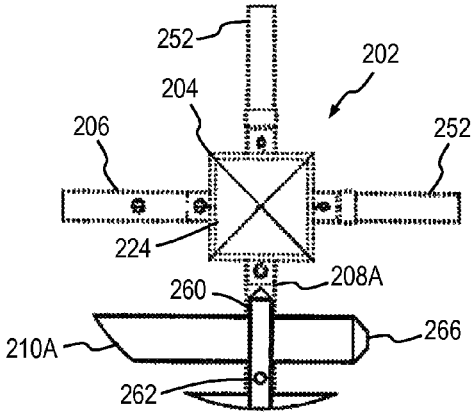
FIGS. 23, 24 and 25 show details of the attachment of purlins to the pergola system of FIG. 22.
Figure 24:
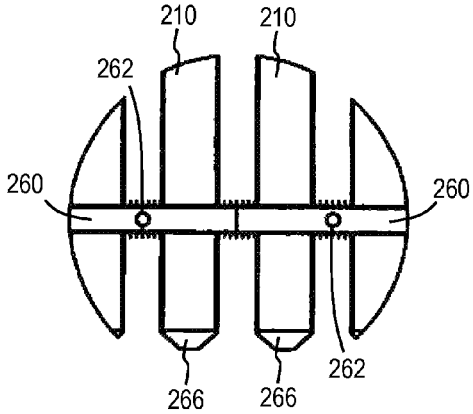
Figure 25:
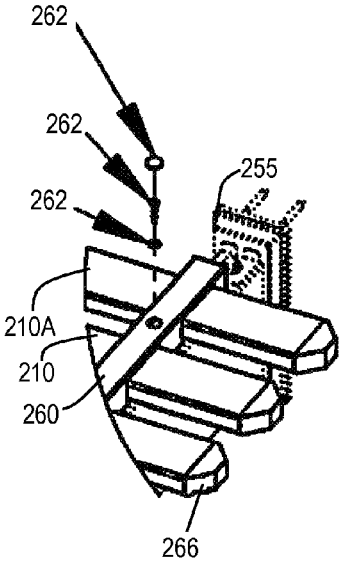

Details of the assembly of purlins 210 to frame 202 are shown in FIGS. 22 through 25 according to an embodiment of the present invention. Purlins 210 are placed atop rails 208, 208A and arranged as generally shown in FIG. 22. Purlins 210 are then secured to rails 208, 208A with purlin mounts 260 that fit over the purlins, the purlin mounts being coupled to rails 208, 208A with purlin mounting hardware 262. Purlin mounting hardware 262 may include self-tapping screws, washers and screw covers. Purlin rail caps 264 are coupled to outer purlins, indicated in FIGS. 22 and 23 as 210A. In addition, purlin caps 266 are coupled to purlins 210, 210A to close off the ends of the purlins.

Preferably, many of the components of system 200 are made from weather-resistant materials such as plastic or composites, including polyvinyl chloride (PVC). Such components include, without limitation, rails 208, 208A, purlins 210, 210A, post sleeve 220, dress skirt 222, post cap 224, frame sleeve 236, decorative sleeve 248, decorative end 252, purlin mounts 260, outer sleeve 259, purlin rail caps 264 and purlin caps 266. In some embodiments some or all of frame member 206, rails 208, 208A and purlins 210 may have an extruded core made from any combination of metal, plastic and composite material, with or without an exterior covering of plastic such as PVC. Alternatively, some or all of frame member 206, rails 208, 208A and purlins 210 may be made as integral pieces from any of metal, plastic and composite material.

In one embodiment of the present invention the various components of pergola system 200 are supplied in kit form with pre-fabricated and pre-cut components. The components may further be provided with openings for the insertion of hardware, for further ease of assembly. Such a pergola system is easily installed by the average homeowner using commonly available tools.

Figure 26:
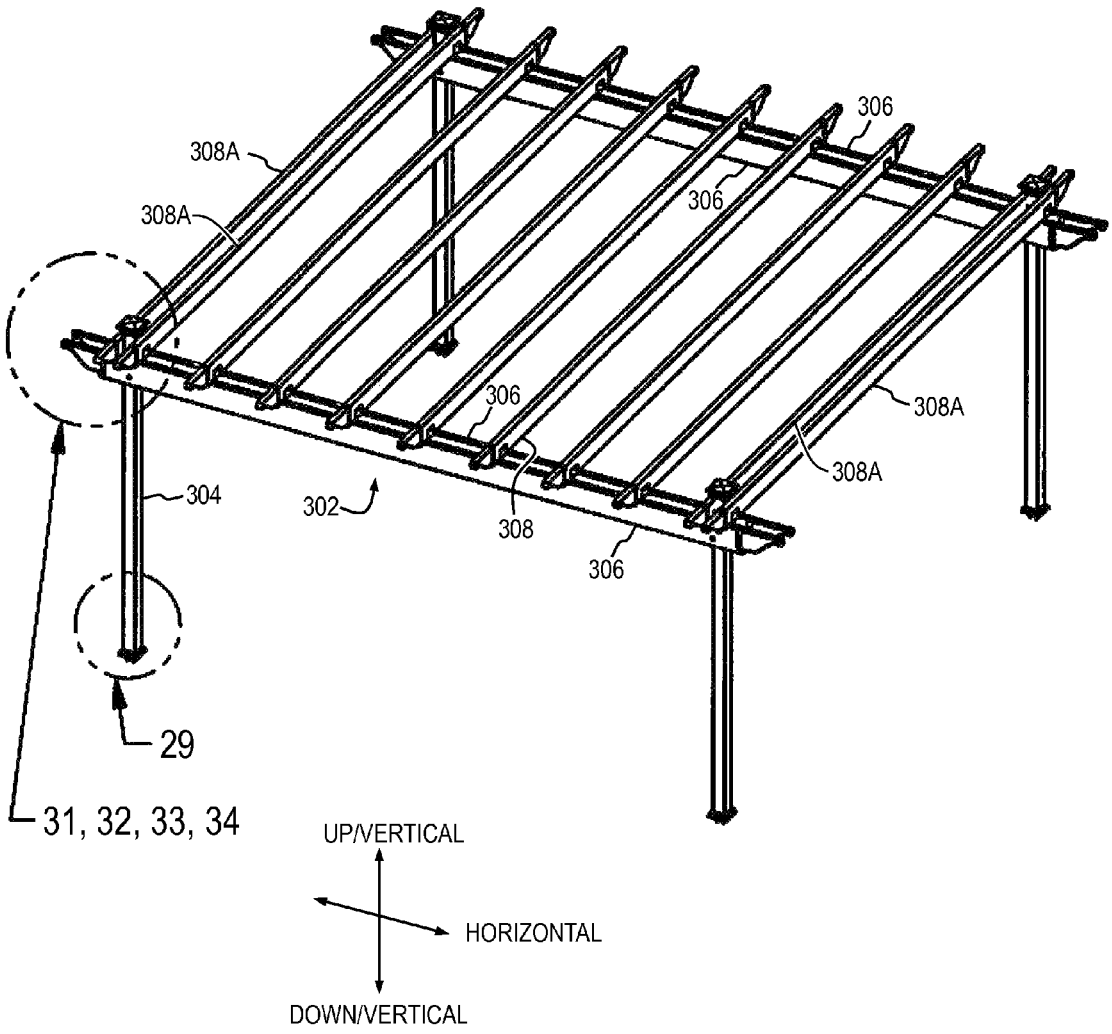
FIG. 26 is a perspective view showing a frame of a freestanding pergola system according to yet another embodiment of the present invention.
Figure 27:
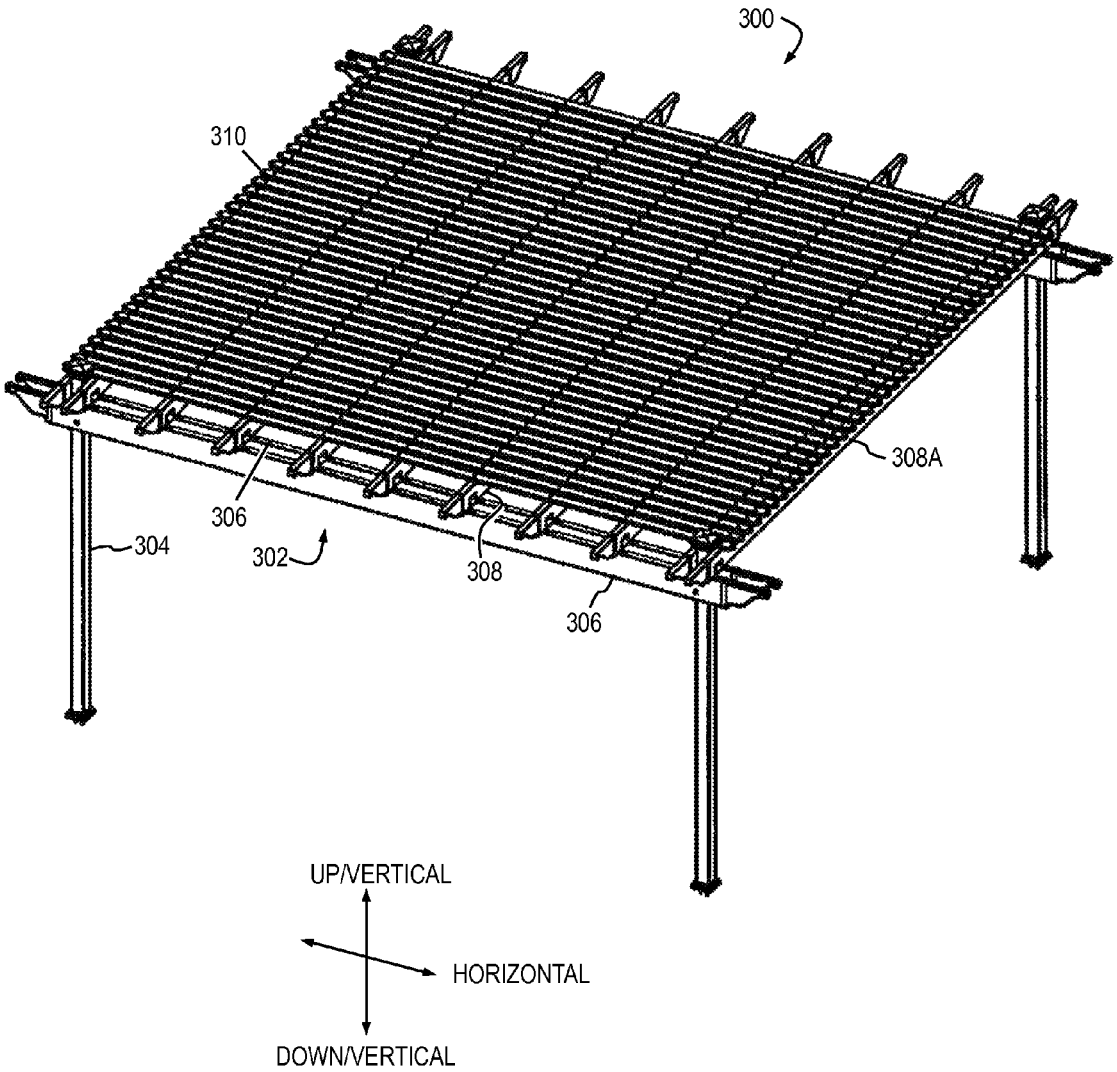
FIG. 27 shows a plurality of purlins coupled to the frame of FIG. 27.

The general arrangement of a freestanding pergola system 300 is shown in FIGS. 26 through 40 according to an embodiment of the present invention. With reference to FIG. 26, system 300 comprises a frame 302 having a plurality of generally vertically-oriented, spaced-apart posts 304 that are aligned in rows. A pair of spaced-apart, generally horizontally-oriented, frame members 306 are attached to each row of posts 304. A plurality of rails 308 extend across frame members 306 and are attached to the frame members in a manner discussed in more detail below. Preferably, rails 308 are oriented generally orthogonally to frame members 306. A plurality of purlins 310 extend across rails 308 and are attached to the rails as shown in FIG. 27. Preferably, purlins 310 are oriented generally orthogonally to rails 308 in a manner discussed in more detail below. The general arrangement of an assembled pergola system 300 is shown in FIG. 27.

Figure 28:
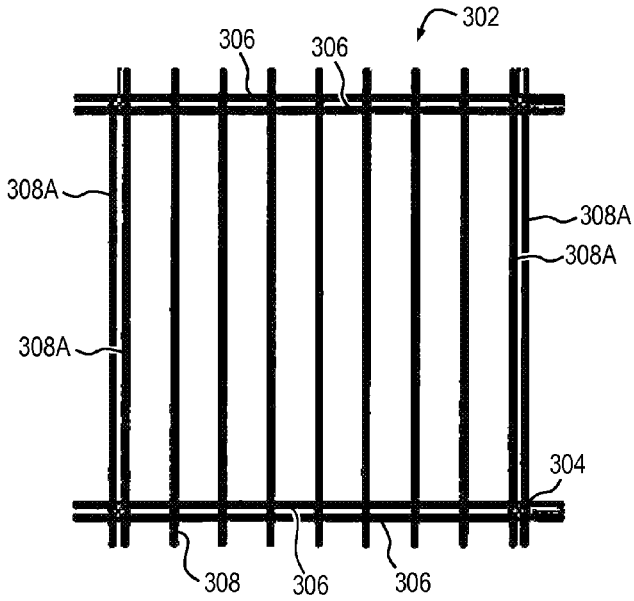
FIG. 28 is a schematic plan view showing the relative spacing of frame members and purlins of the assembly of FIG. 27.

FIG. 28 is a schematic plan view of frame 302. In one embodiment of the present invention sets of frame members 306 are spaced about sixteen feet apart from each other. Likewise, a set of outer rails, indicated in FIGS. 26 and 28 as "308A," are spaced about sixteen feet apart from each other, with a plurality of rails 308 being generally evenly spaced therebetween and attached to frame 302 and frame members 306 in a manner discussed in more detail below. The foregoing dimensions describe an exemplary frame 302 of a pergola system 300 but are not intended to be limiting in any way, as one skilled in the art will appreciate that these dimensions may be varied to suit a particular installation.

Figure 29:
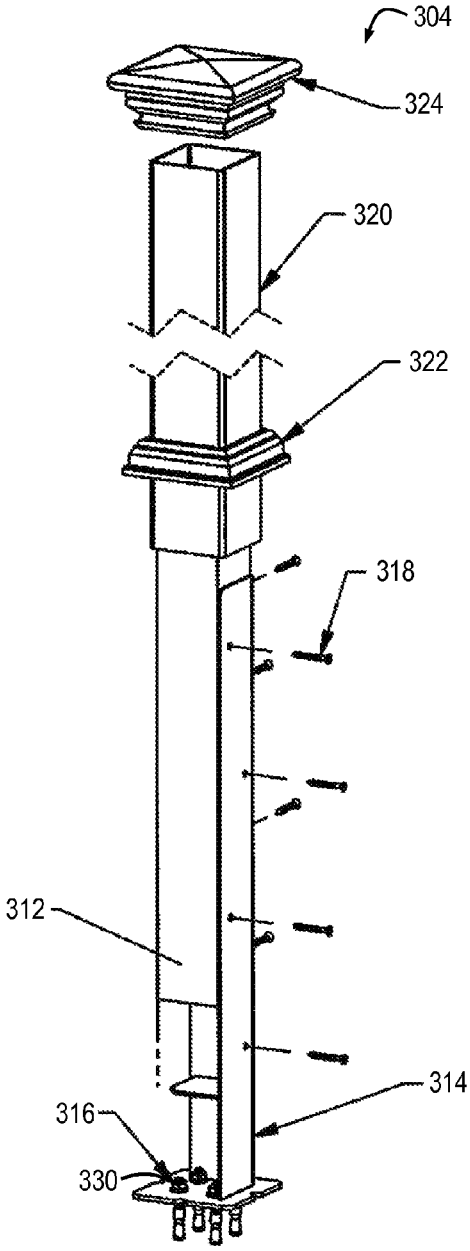
FIG. 29 is an exploded view of a post of the frame of FIG. 26.
Figure 31:
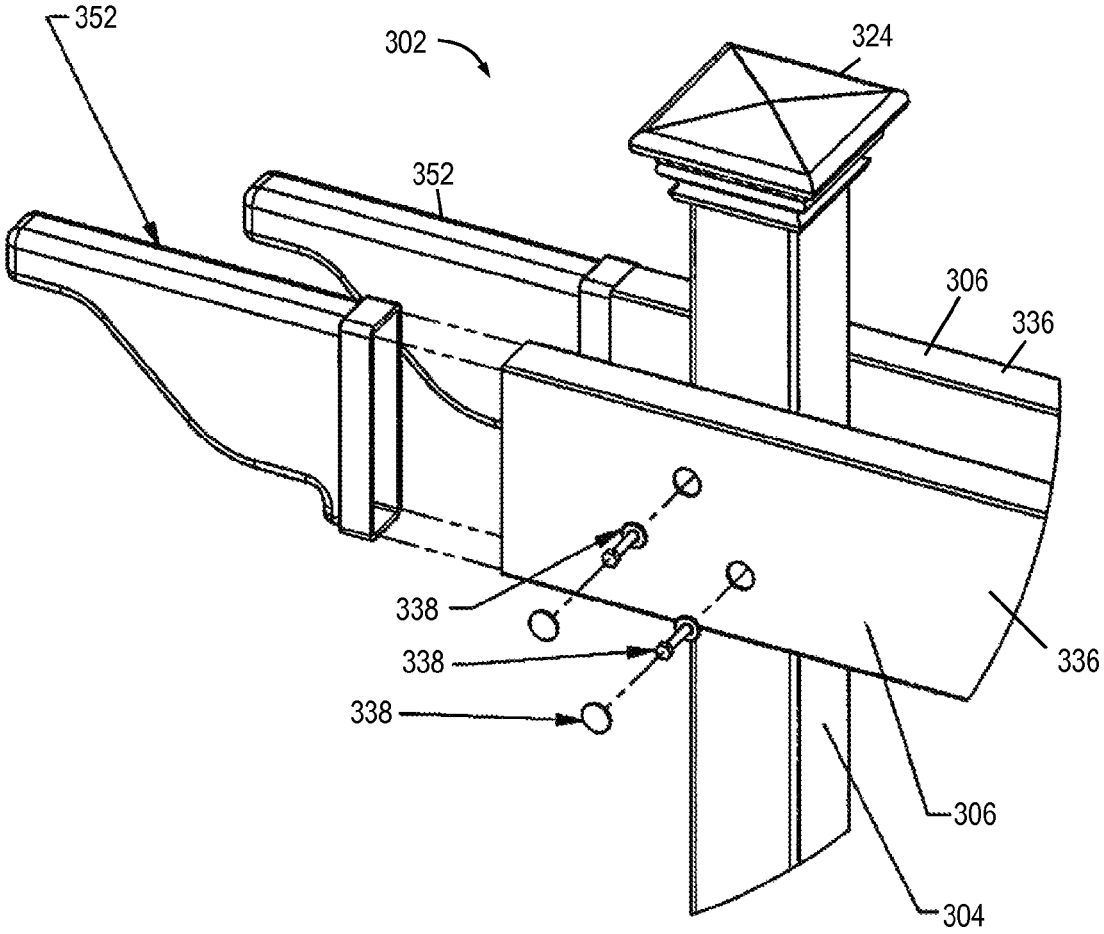
FIGS. 31, 32, 33 and 34 show additional details of the assembly of the frame of FIG. 26, as well as the attachment of decorative elements.
Figure 33:
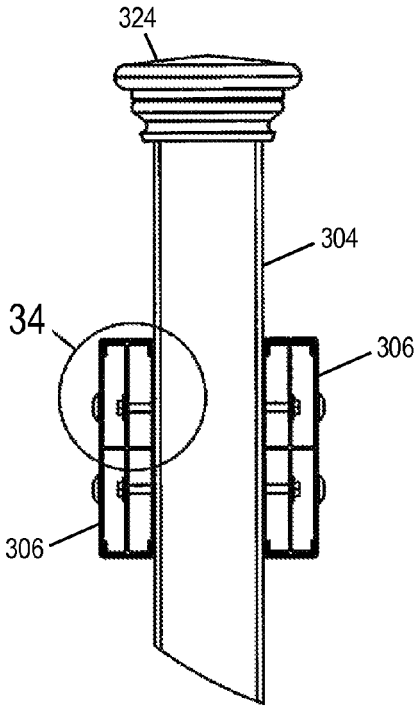
Figure 32:
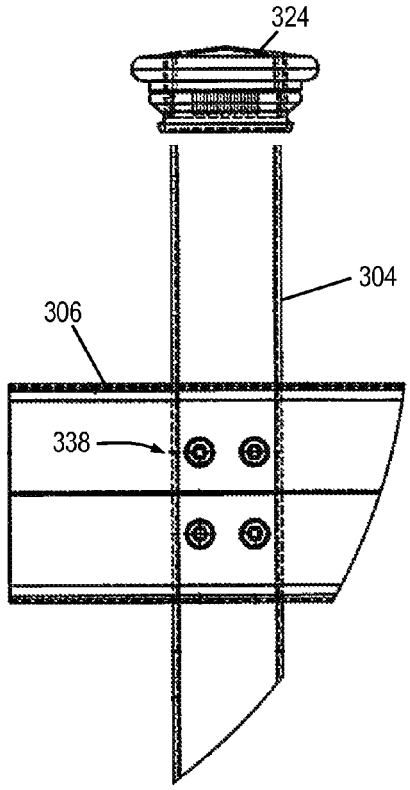

FIG. 29 shows details of an example post 304 of system 300. In one embodiment post 304 comprises a support member 312, such as standard "4×4" treated lumber of a suitable length. A post bracket 314 includes a set of anchor bolts 316 and is sized and shaped to receive support member 312. Attachment hardware 318, such as bolts and screws, is utilized to join support member 312 to post bracket 314. A hollow post sleeve 320 fits slidably over the assembled support member 312 and post bracket 314. Decorative items such as a dress skirt 322 and a post cap 324 may be added to post 304, if desired.

Figure 30:
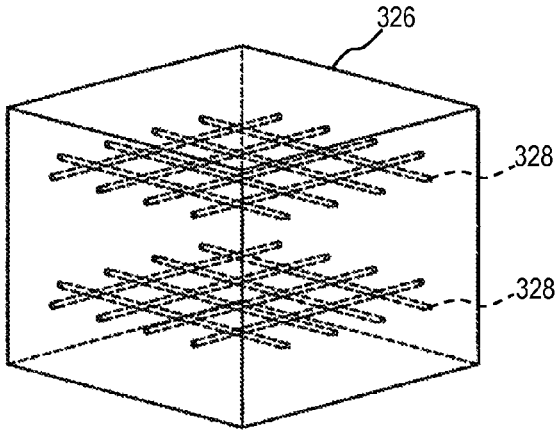
FIG. 30 shows a footing usable with the post of FIG. 26.

A footing space 326, shown in FIG. 30, is one example of a means which may be used at an installation site for system 300 to secure post 304. Footing 326 may be made from concrete of a suitable mass, such as about 30 inches square and about 24 inches in height, although other dimensions are contemplated within the scope of the invention. Reinforcing steel 328 may be embedded in footing 326 to increase the structural integrity of the footing. Alternatively, post 304 may be anchored to a suitable concrete slab. Anchor bolts 316 (FIG. 29) are preferably joined to or embedded in footing 326, post 304 being attached to the anchor bolts with a set of nuts 330 configured to be threadably coupled to the anchor bolts.

Details of the assembly of frame 302 are shown in FIG. 31 through 34 according to an embodiment of the present invention. In one embodiment frame members 306 comprise a metal or composite extrusion with a hollow plastic sleeve 336 for an outer covering. A pair of frame members 306 are placed on opposing sides of a post 304. Frame member mounting hardware 338, which may include bolts, flat washers, lock washers and plug caps, extends through each frame member 306 and into post 304. In one embodiment frame member mounting hardware 338 includes threaded screws or bolts that engage threaded apertures or inserts 340 of post 304. Alternatively, threaded screws of hardware 338 may be screwed directly into support member 312 (FIG. 29). A decorative end 352 is coupled to the ends of each frame member 306.

Figure 34:
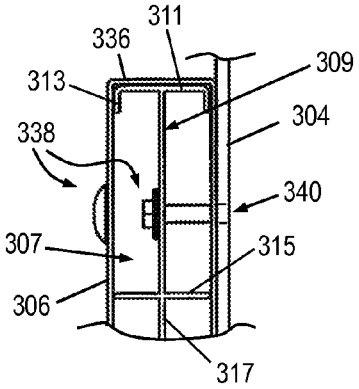

With particular reference to FIG. 34, frame member 306 includes a frame structural member 307. Frame structural member 307 includes an "I" beam portion 309, of which one half is shown. Each generally horizontal end 311 of the "I" beam portion 309 includes a pair of generally vertically-oriented lips 313. A generally horizontally-oriented reinforcing rib 315 extends from a vertical portion 317 of "I" beam portion 309, intermediate the horizontal ends 311.

Figure 35:
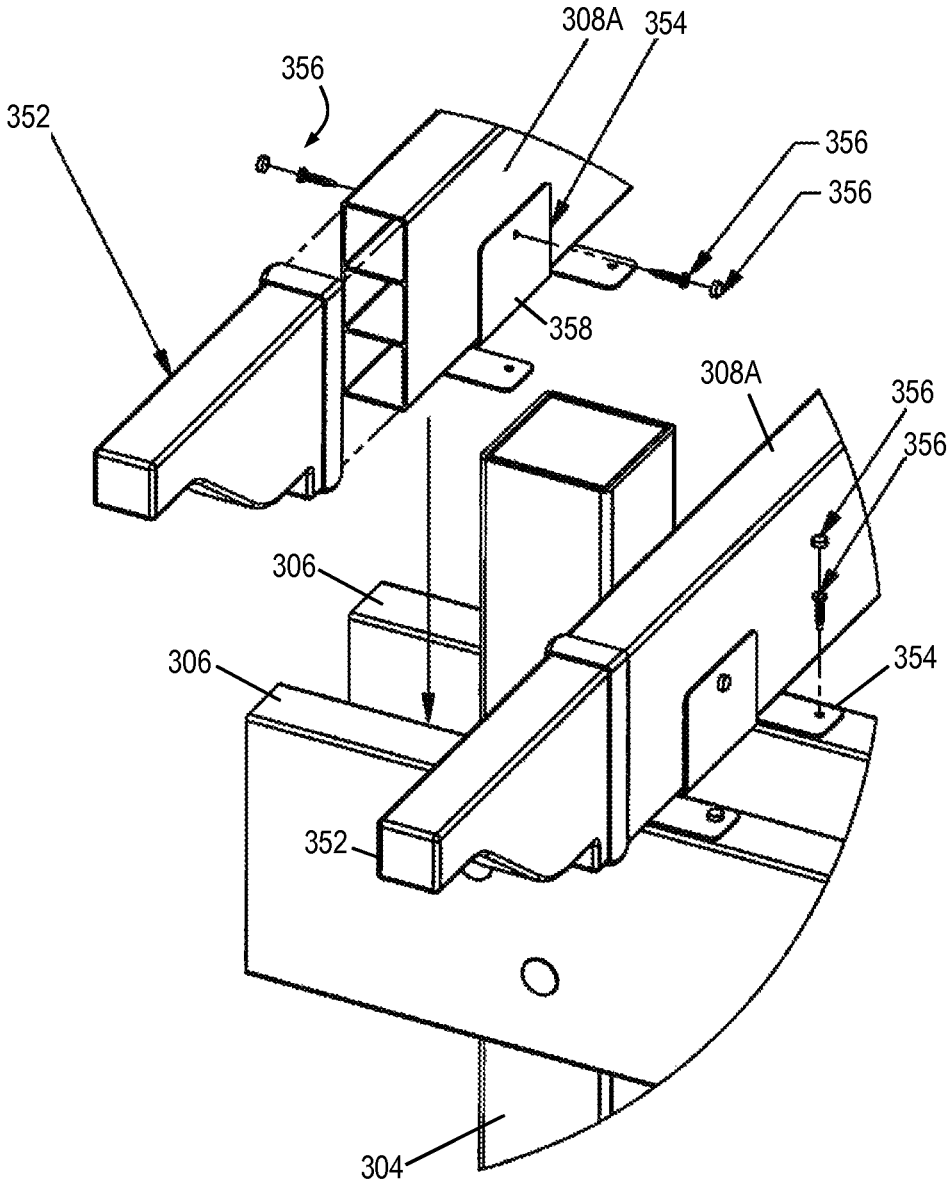
FIGS. 35, 36 and 37 show details of the assembly of multiple rails to the frame of FIG. 26.
Figure 36:
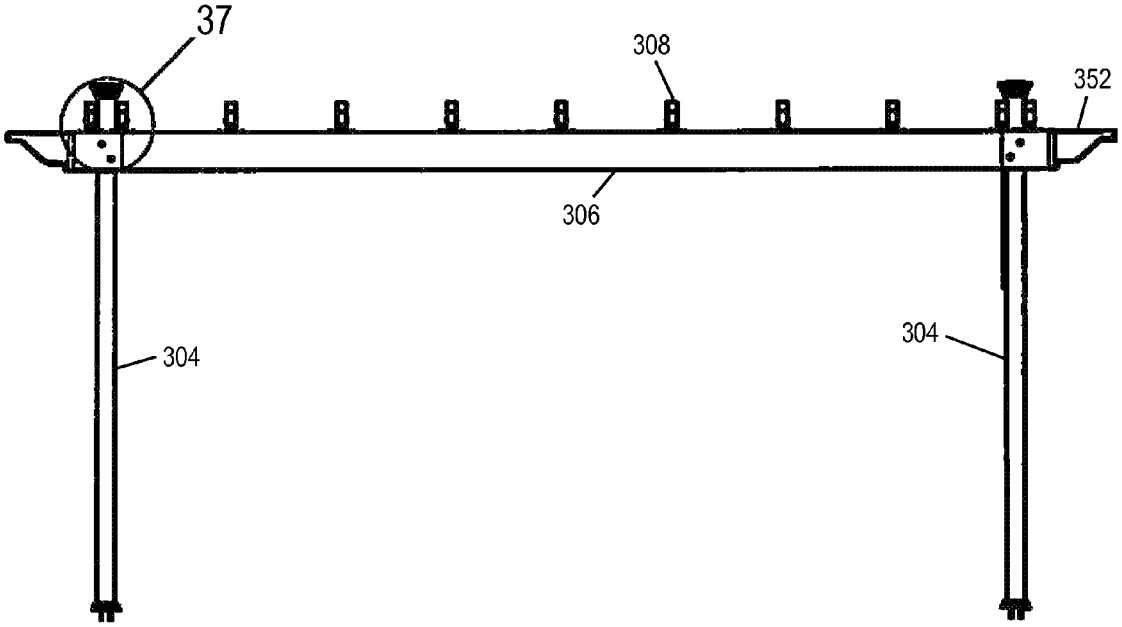
Figure 37:
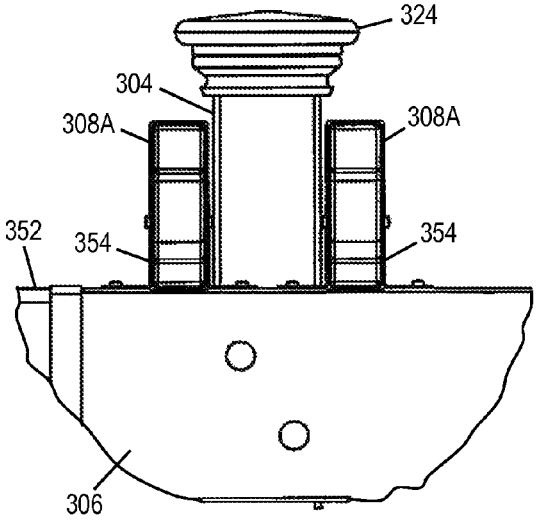

Details of the assembly of outer rails 308A to frame 302 is shown in FIGS. 35 through 37 according to an embodiment of the present invention. A rail bracket 354 having tabs 358 is attached to each outer rail 308A with rail attachment hardware 356 as shown, which may include screws or bolts and screw caps. The outer rails are positioned on opposing sides of a post 304 and secured to frame members 306 with rail attachment hardware 356. A decorative end 352 is coupled to the ends of each outer rail 308A with hardware or adhesive. Rails 308 are attached to frame members 306 in a similar manner.

Figure 38:
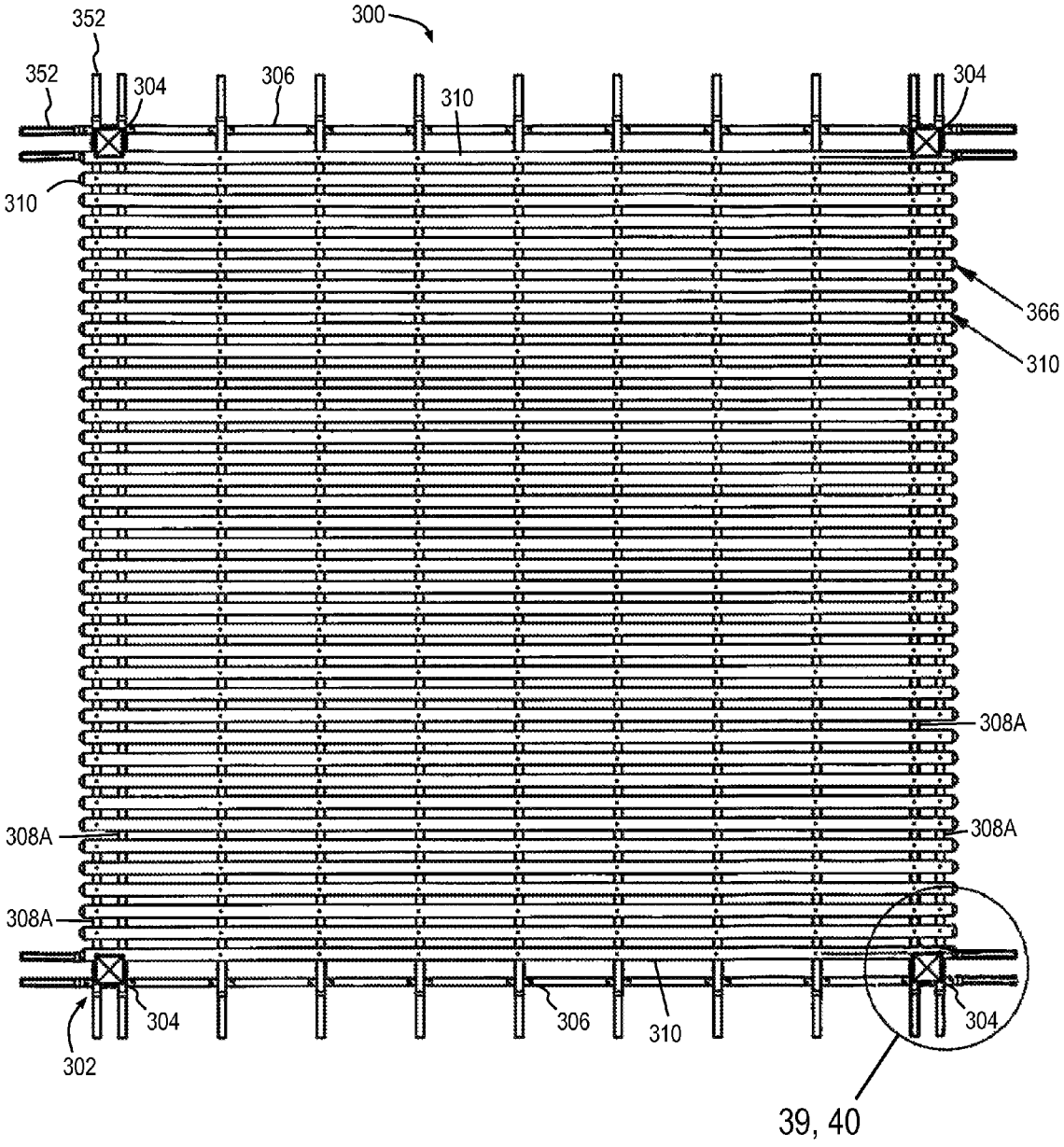
FIG. 38 is a plan view of a freestanding pergola system according to still another embodiment of the present invention.
Figure 39:
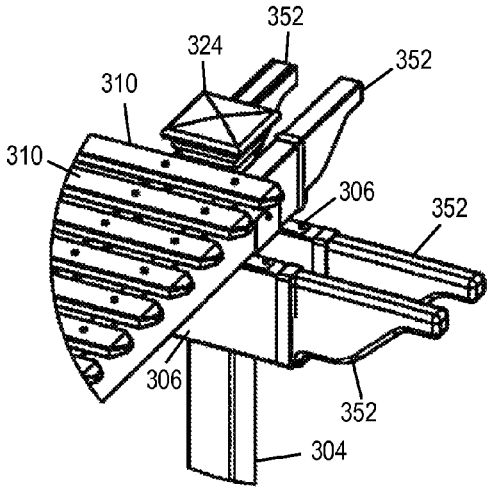
FIGS. 39 and 40 show details of the attachment of purlins to the pergola system of FIG. 38.
Figure 40:
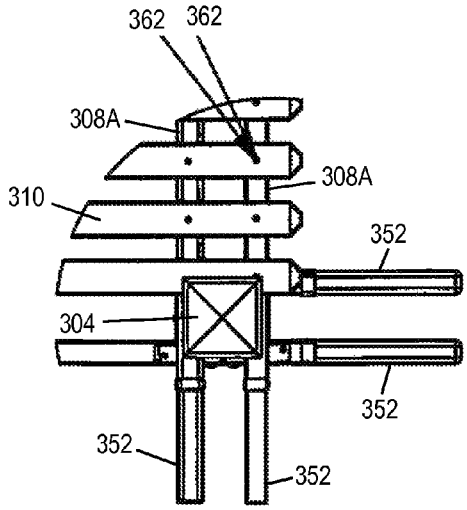

Details of the assembly of purlins 310 to frame 302 are shown in FIGS. 38 through 40 according to an embodiment of the present invention. Purlins 310 are placed atop rails 308, 308A and arranged as generally shown in FIG. 38. Purlins 310 are then secured to rails 308, 308A with purlin mounting hardware 362. Purlin mounting hardware 362 may include self-tapping screws and screw covers. In addition, purlin caps 366 are coupled to purlins 310 to close off the ends of the purlins.

Preferably, many of the components of system 300 are made from weather-resistant materials such as plastic or composites, including polyvinyl chloride (PVC). Such components include, without limitation, rails 308, 308A, purlins 310, post sleeve 320, dress skirt 322, post cap 324, frame sleeve 336, decorative sleeve 348, decorative end 352, purlin mounts 360 and purlin caps 366. In some embodiments some or all of frame members 306, rails 308, 308A and purlins 310 may have an extruded core made from any combination of metal, plastic and composite material, with or without an exterior covering of plastic such as PVC. Alternatively, some or all of frame members 306, rails 308, 308A and purlins 310 may be made as integral pieces from any of metal, plastic and composite material.

In one embodiment of the present invention the various components of pergola system 300 are supplied in kit form with pre-fabricated and pre-cut components. The components may further be provided with openings for the insertion of hardware, for further ease of assembly. Such a pergola system is easily installed by the average homeowner with commonly available tools.

Figure 41:
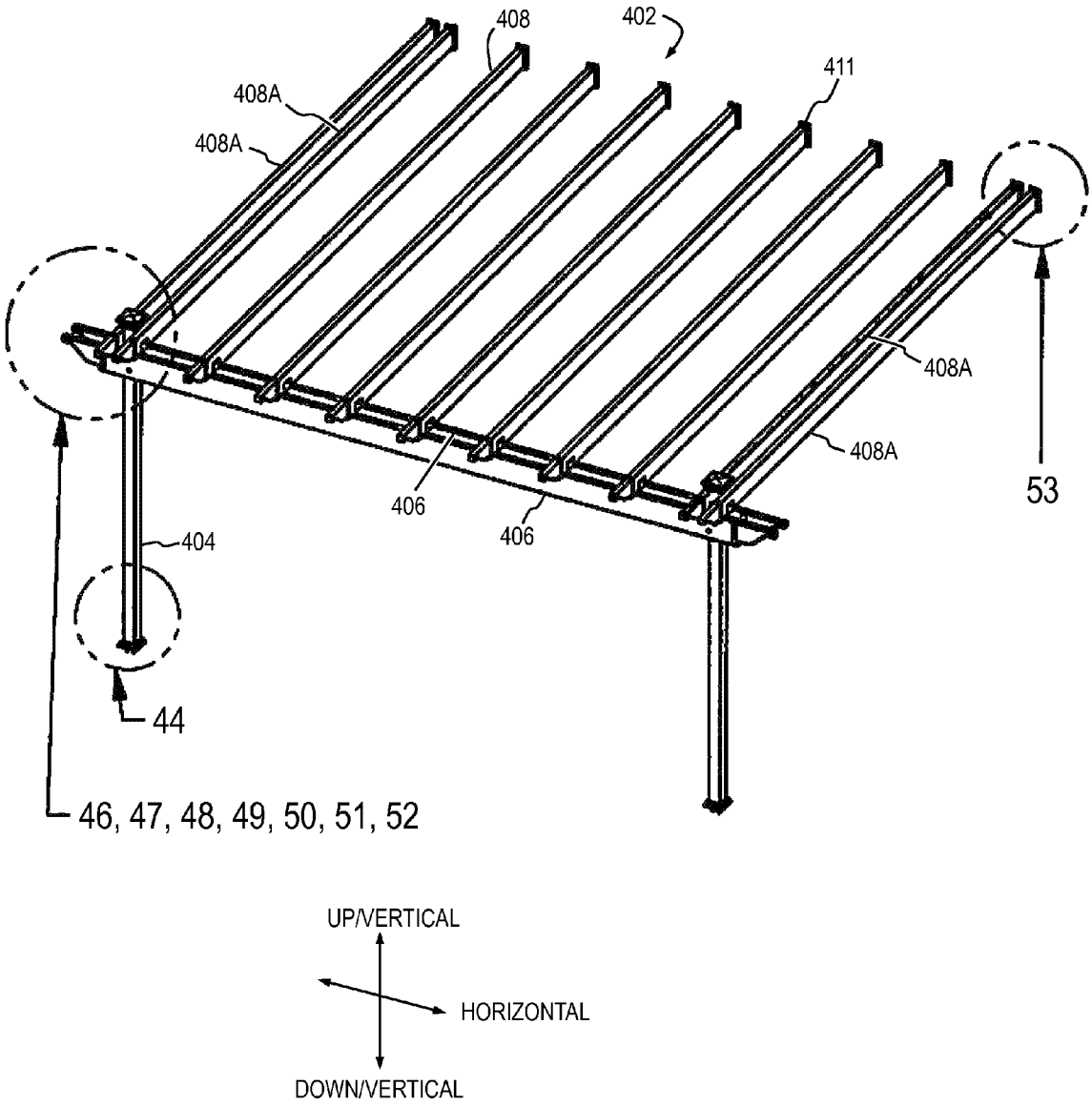
FIG. 41 is a perspective view showing the frame of a pergola system attachable to a building structure according to still another embodiment of the present invention.
Figure 42:
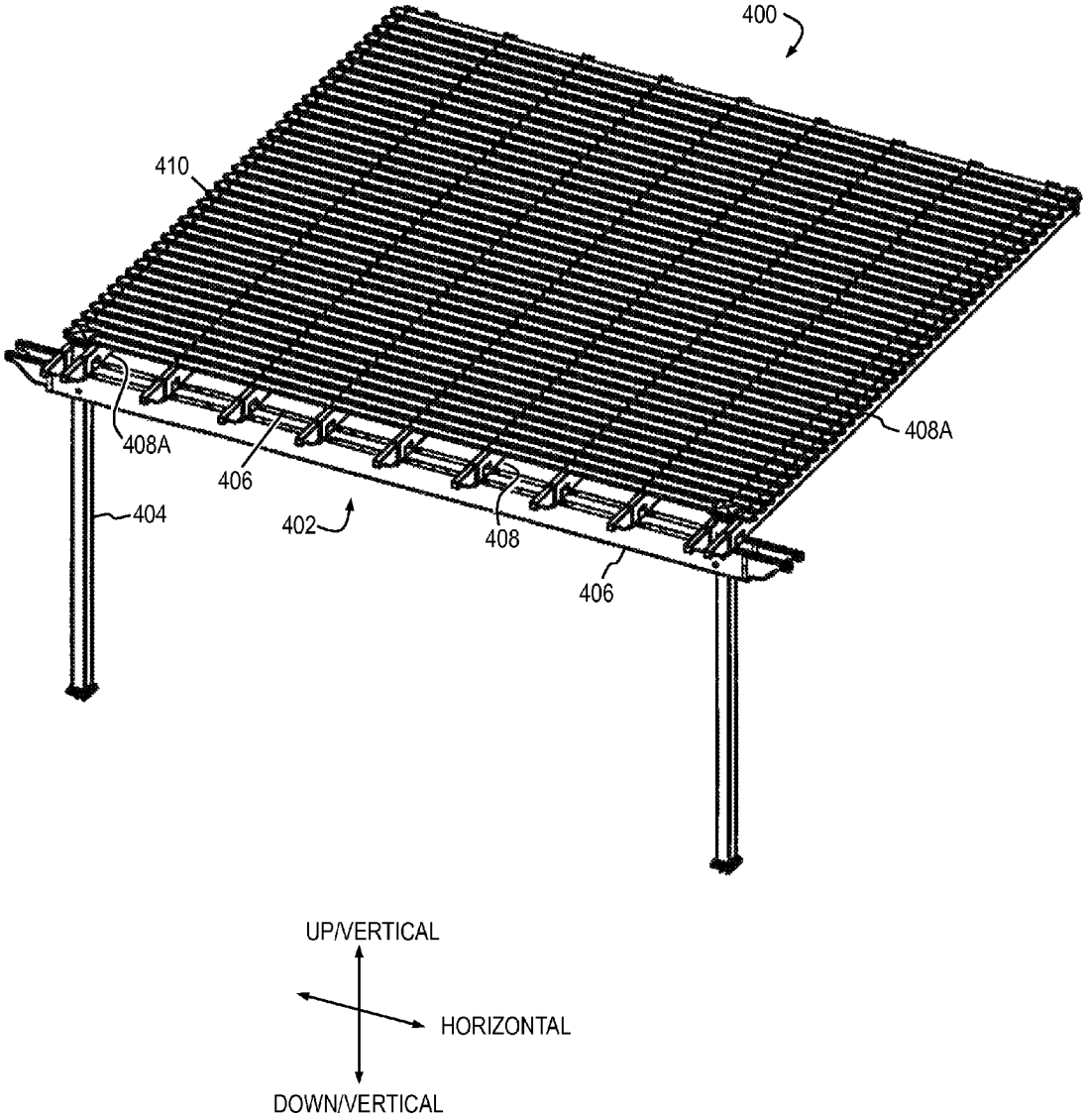
FIG. 42 shows a plurality of purlins coupled to the frame of FIG. 41.

The general arrangement of a pergola system 400 attachable to a building structure is shown in FIGS. 41 through 56 according to an embodiment of the present invention. With reference to FIG. 41, system 400 comprises a frame 402 having a plurality of generally vertically-oriented, spaced-apart posts 404 that are aligned in a row. A generally horizontally-oriented, spaced-apart frame member 406 is attached to the row of posts 404. A plurality of rails 408 extend across frame member 406 and are attached to the frame member in a manner discussed in more detail below. Preferably, rails 408 are oriented generally orthogonally to frame member 406. A plurality of purlins 410 extend across rails 408 and are attached to the rails in a manner discussed in more detail below. Preferably, purlins 410 are oriented generally orthogonally to rails 408 as shown in FIG. 42. A building structure attachment bracket 411 is coupled to each rail 408 at a first end of the rail, a second, opposing end of the rail being proximate frame member 406 as shown in FIG. 41. The general arrangement of an assembled pergola system 400 is shown in FIG. 42.

Figure 43:
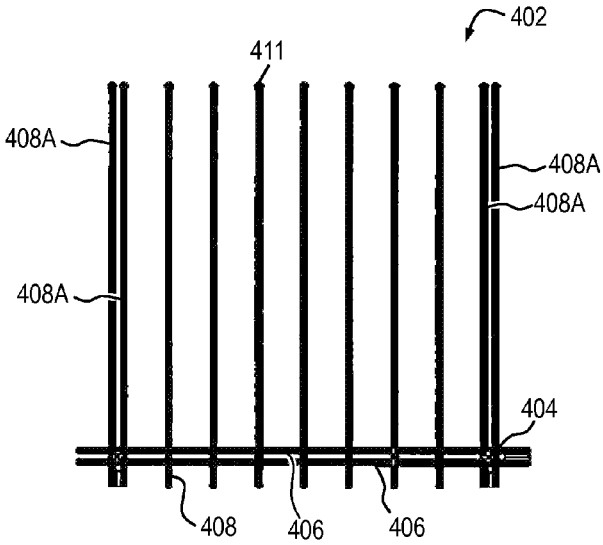
FIG. 43 is a schematic plan view showing the relative spacing of frame members and purlins of the assembly of FIG. 42.

FIG. 43 is a schematic plan view of frame 402. In one embodiment of the present invention a set of frame members 406 are spaced about sixteen feet from apart from building structure attachment bracket 411. Likewise, sets of outer rails, indicated in FIGS. 41 and 43 as "408A," are spaced about sixteen feet apart from each other, with a plurality of rails 408 being generally evenly spaced therebetween and attached to frame member 406 in a manner discussed in more detail below. The foregoing dimensions describe an exemplary frame 402 of a pergola system 400 but are not intended to be limiting in any way, as one skilled in the art will appreciate that these dimensions may be varied to suit a particular installation.

Figure 44:
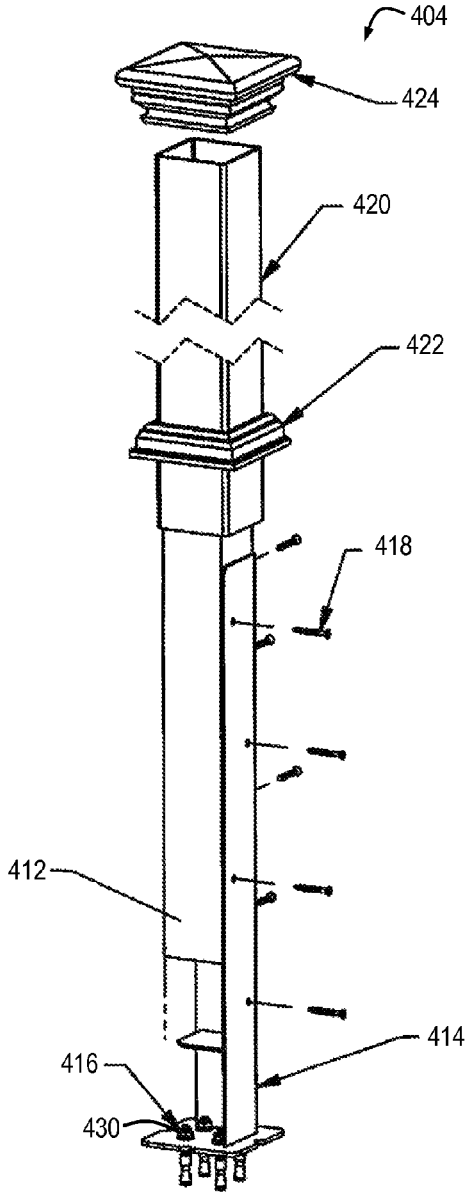
FIG. 44 is an exploded view of a post of the frame of FIG. 41.
Figure 46:
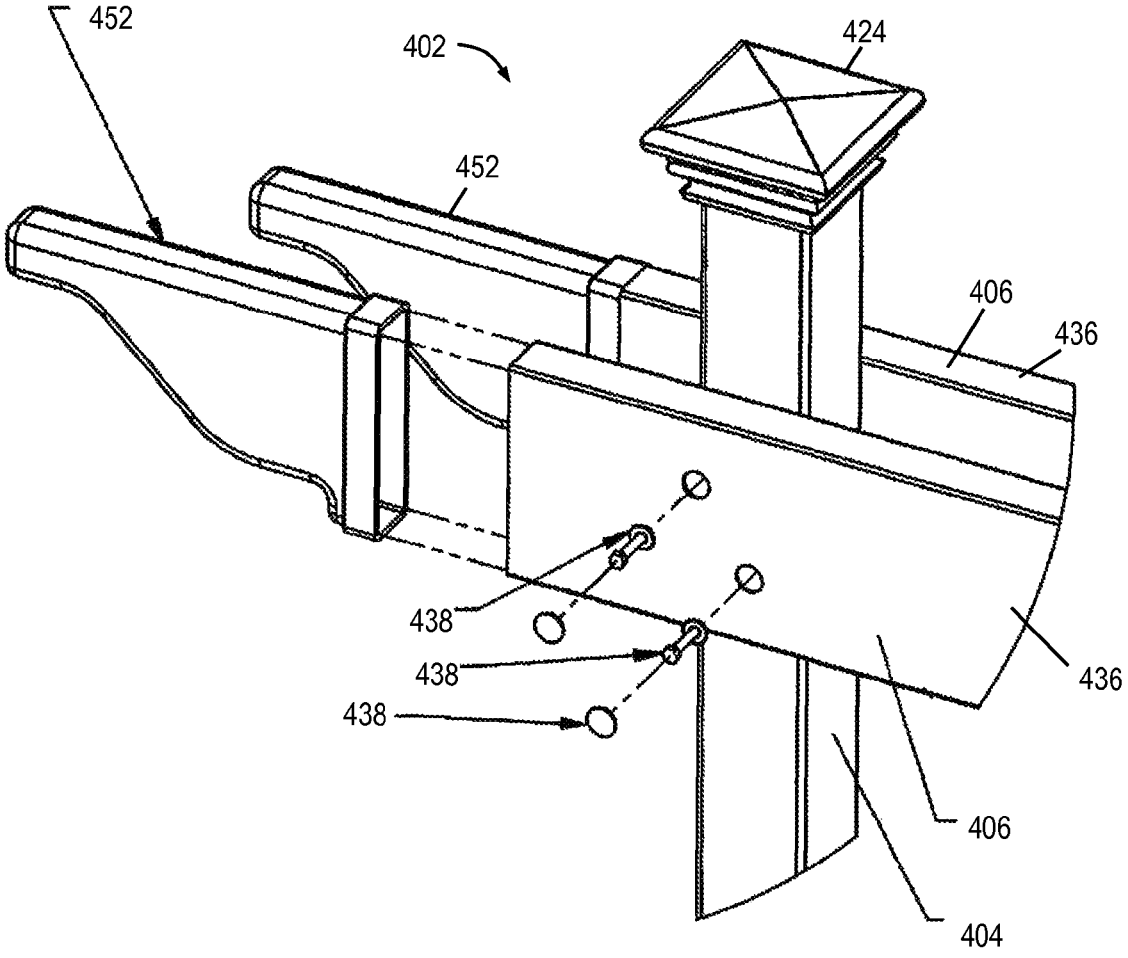
FIGS. 46, 47, 48 and 49 show additional details of the assembly of the frame of FIG. 41, as well as the attachment of decorative elements.
Figure 48:
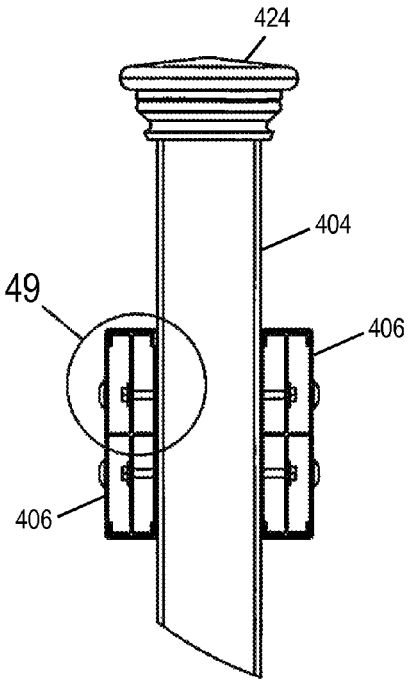
Figure 47:
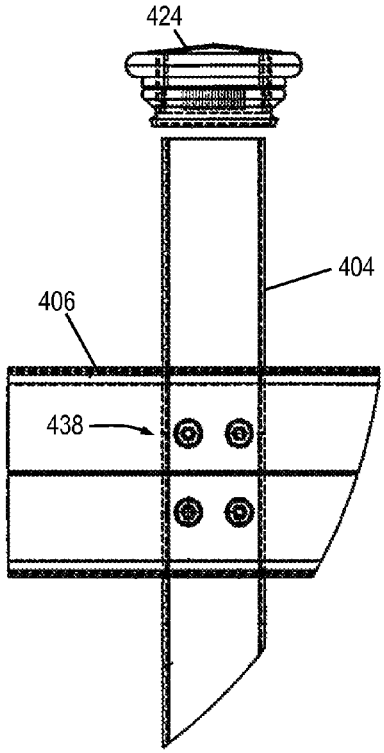

FIG. 44 shows details of an example post 404 of system 400. In one embodiment post 404 comprises a support member 412, such as standard "4×4" treated lumber of a suitable length. A post bracket 414 includes a set of anchor bolts 416 and is sized and shaped to receive support member 412. Attachment hardware 418, such as bolts and screws, is utilized to join support member 412 to post bracket 414. A hollow post sleeve 420 fits slidably over the assembled support member 412 and post bracket 414. Decorative items such as a dress skirt 422 and a post cap 424 may be added to post 404, if desired.

Figure 45:
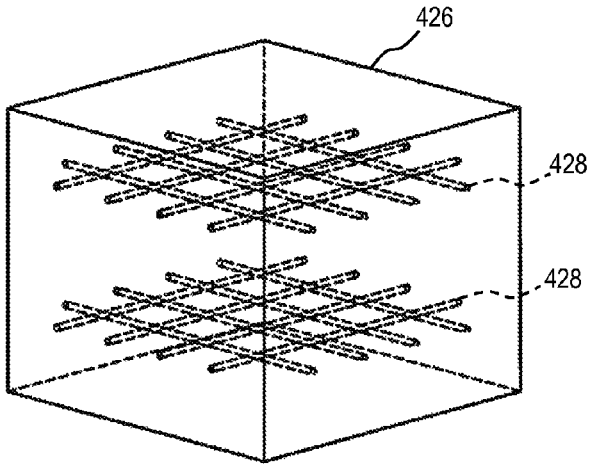
FIG. 45 shows a footing usable with the post of FIG. 44.

A footing space 426, shown in FIG. 45, is one example of a means which may be used at an installation site for system 400 to secure post 404. Footing 426 may be made from concrete of a suitable mass, such as about 30 inches square and about 24 inches in height, although other dimensions are contemplated within the scope of the invention. Reinforcing steel 428 may be embedded in footing 426 to increase the structural integrity of the footing. Alternatively, post 404 may be anchored to a suitable concrete slab. Anchor bolts 416 (FIG. 44) are preferably joined to or embedded in footing 426, post 404 being attached to the anchor bolts with a set of nuts 430 configured to be threadably coupled to the anchor bolts.

Details of the assembly of frame 402 are shown in FIGS. 46 through 52 according to an embodiment of the present invention. In one embodiment frame members 406 comprise a metal or composite extrusion with a hollow plastic sleeve 436 for an outer covering. A pair of frame members 406 are placed on opposing sides of a post 404. Frame member mounting hardware 438, which may include bolts, flat washers, lock washers and plug caps, extends through each frame member 406 and into post 404. In one embodiment frame member mounting hardware 438 includes threaded screws or bolts that engage threaded apertures or inserts 440 of post 404. Alternatively, threaded screws of hardware 438 may be screwed directly into support member 412 (FIG. 44). A decorative end 452 is coupled to the ends of each frame member 406.

Figure 49:
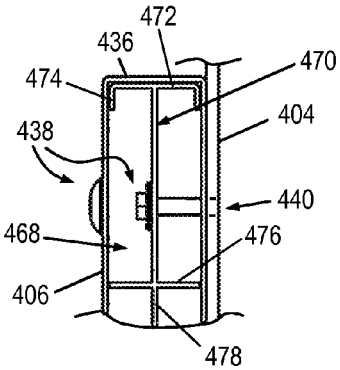

With particular reference to FIG. 49, frame member 406 includes a frame structural member 468. Frame structural member 468 includes an "I" beam portion 470, of which one half is shown. Each generally horizontal end 472 of the "I"

beam portion 470 includes a pair of generally vertically-oriented lips 474. A generally horizontally-oriented reinforcing rib 476 extends from a vertical portion 478 of "I" beam portion 470, intermediate the horizontal ends 472.

Figure 50:
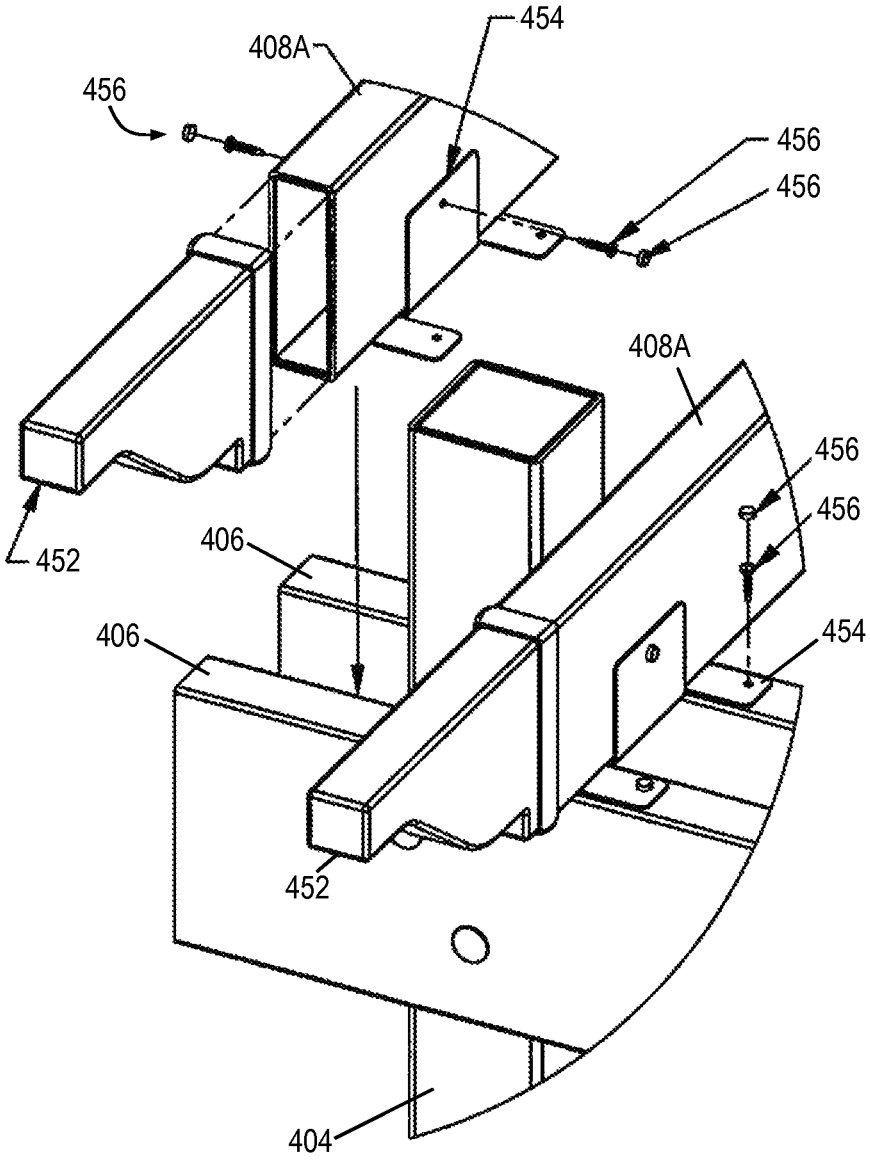
FIGS. 50, 51 and 52 show details of the assembly of multiple rails to the frame of FIG. 41.
Figure 51:
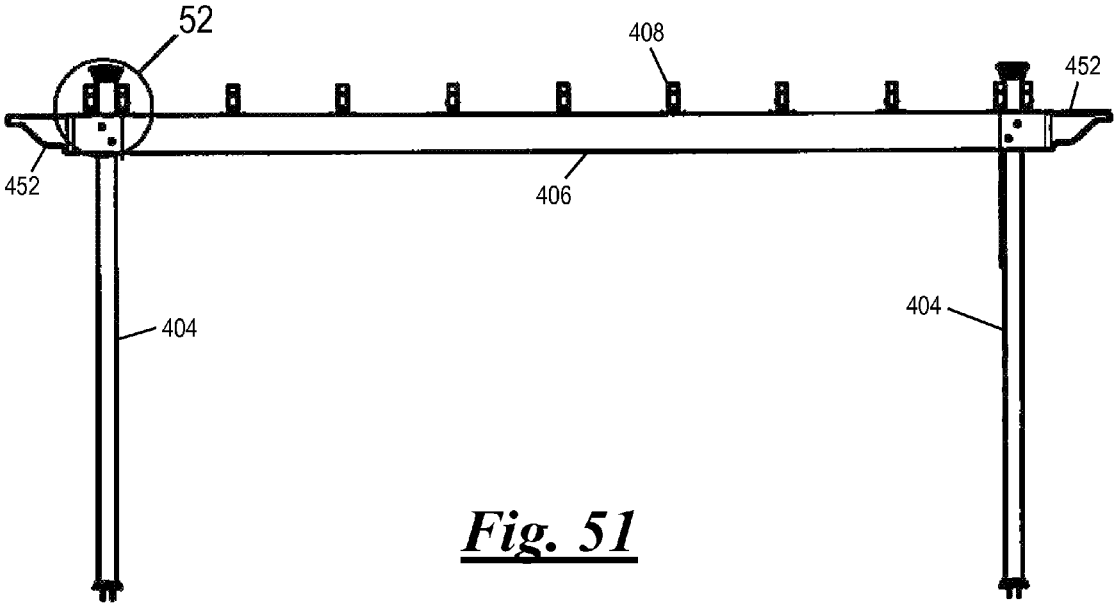
Figure 52:
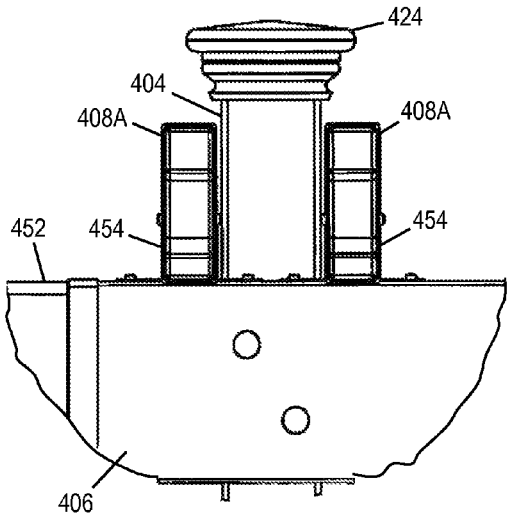

Details of the assembly of outer rails 408A to frame 402 is shown in FIGS. 50 through 52 according to an embodiment of the present invention. A rail bracket 454 is attached to each outer rail 408A with rail attachment hardware 456, which may include screws or bolts and screw caps. The outer rails are positioned on opposing sides of a post 404 and secured to frame members 406 with rail attachment hardware 456. A decorative end 452 is coupled to the ends of each outer rail 408A with hardware or adhesive. Rails 408 are attached to frame members 406 in a similar manner.

Figure 53:
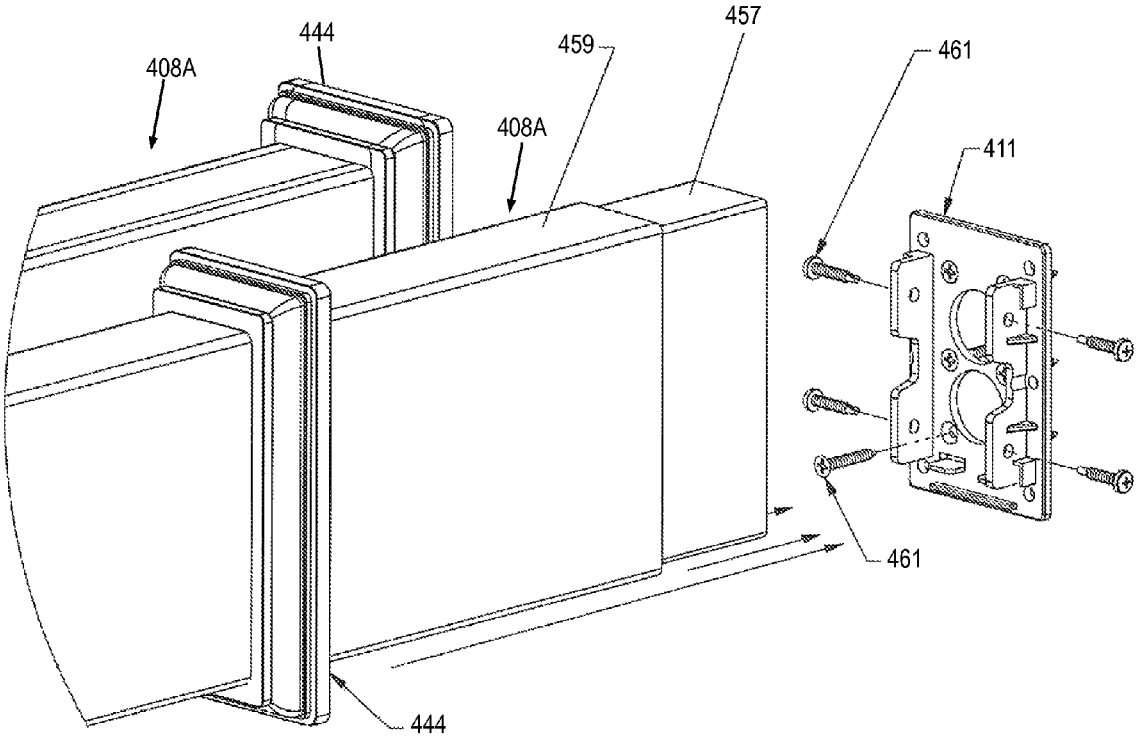
FIG. 53 shows details of portions of the frame of FIG. 41 attachable to a building structure.

FIG. 53 shows details of the assembly of outer rails 408A to a building structure according to an embodiment of the present invention. Building attachment bracket 411 is attached to a hollow connector portion 457 and an outer sleeve 459 of outer rail 408A with building attachment bracket hardware 461, which may include screws or bolts and screw caps. Building attachment bracket 411 is attached to a building structure (not shown) with building attachment bracket hardware 461. A fascia 444 is moved slidably over outer rail 408A proximate building attachment bracket 411. Rails 408 are similarly assembled to the building structure.

Figure 54:
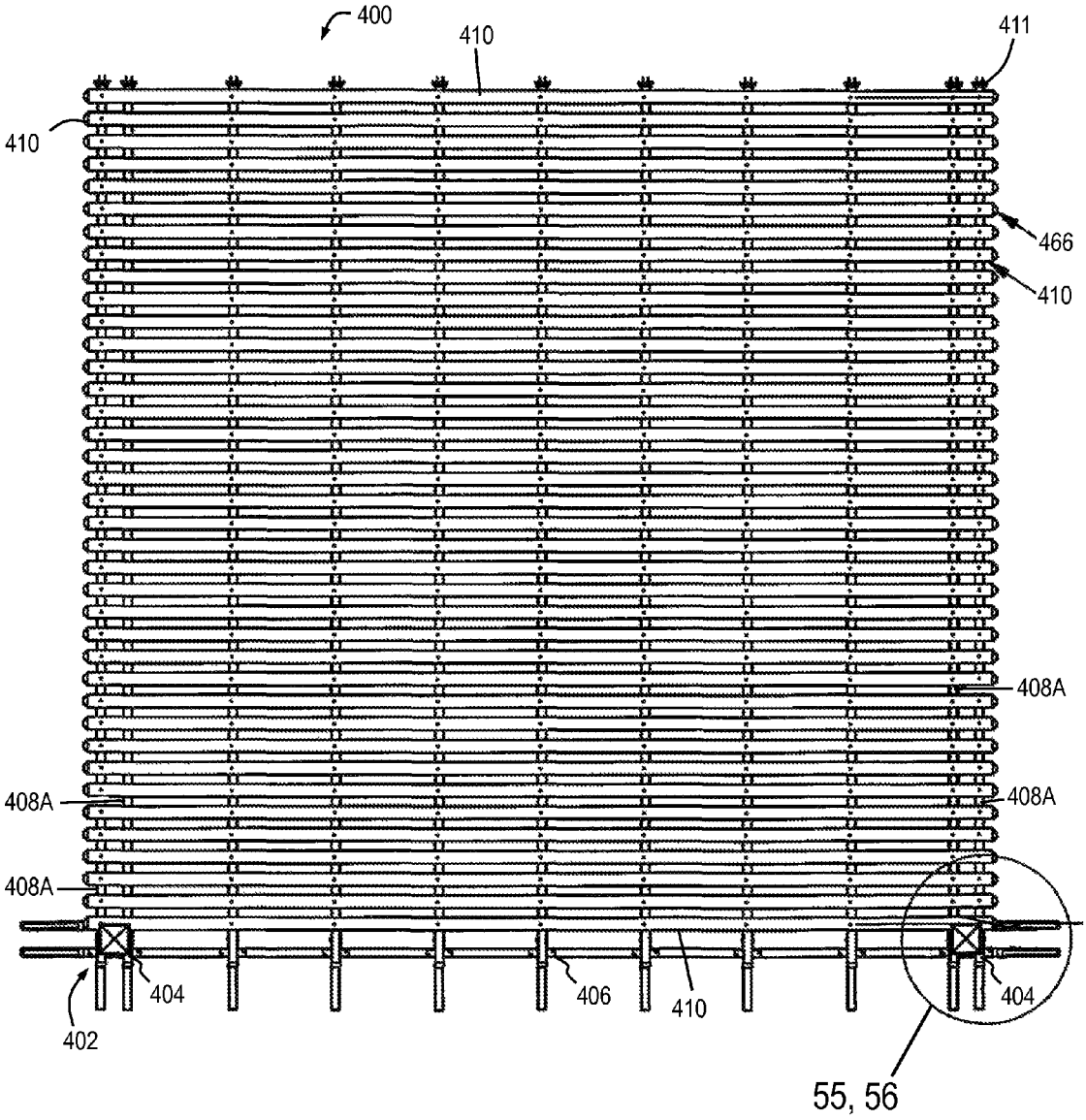
FIG. 54 is a plan view of a pergola system attachable to a building structure according to still another embodiment of the present invention.
Figure 55:
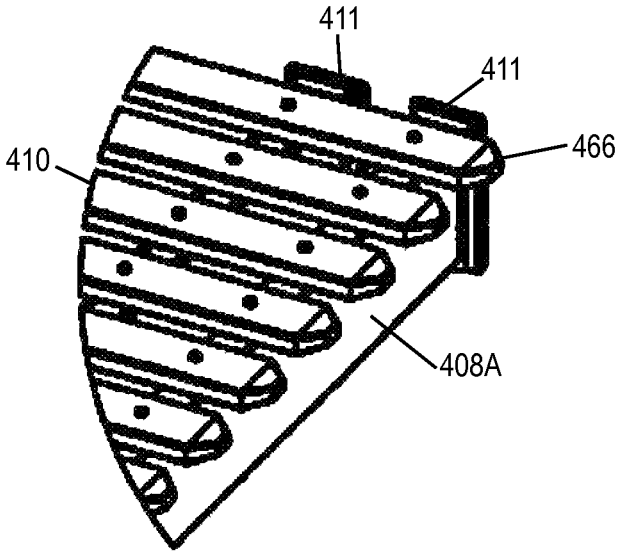
FIGS. 55 and 56 show details of the attachment of purlins to the pergola system of FIG. 54.
Figure 56:
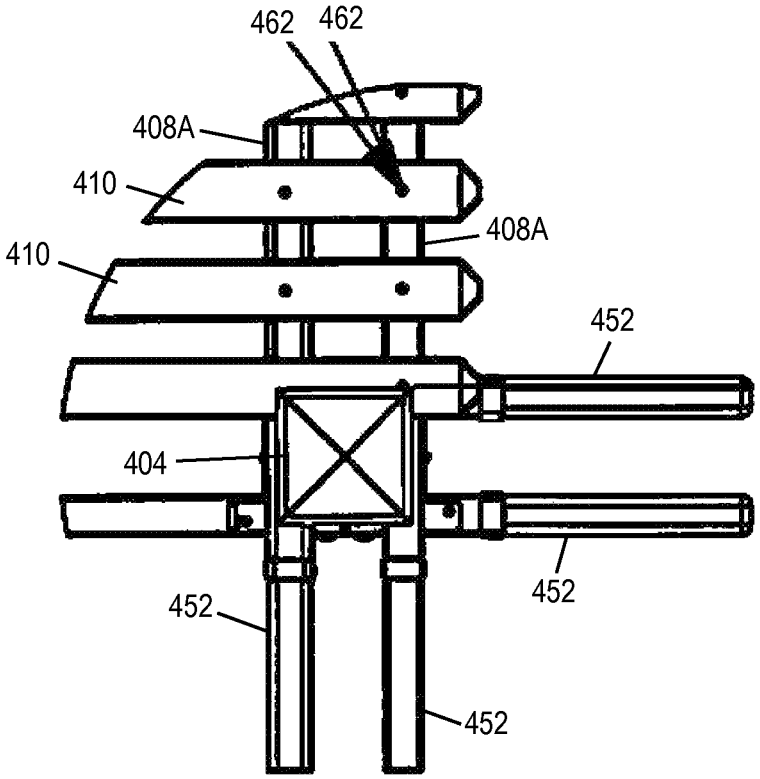

Details of the assembly of purlins 410 to frame 402 are shown in FIGS. 54 through 56 according to an embodiment of the present invention. Purlins 410 are placed atop rails 408, 408A and arranged as generally shown in FIG. 54. Purlins 410 are then secured to rails 408, 408A with purlin mounting hardware 462. Purlin mounting hardware 462 may include self-tapping screws and screw covers. In addition, purlin caps 466 are coupled to purlins 410 to close off the ends of the purlins.

Preferably, many of the components of system 400 are made from weather-resistant materials such as plastic or composites, including polyvinyl chloride (PVC). Such components include, without limitation, rails 408, 408A, purlins 410, post sleeve 420, dress skirt 422, post cap 424, frame sleeve 436, decorative sleeve 448, decorative end 452, purlin mounts 460, outer sleeve 459, purlin rail caps 464 and purlin caps 466. In some embodiments some or all of frame members 406, rails 408, 408A and purlins 410 may have an extruded core made from any combination of metal, plastic and composite material, with or without an exterior covering of plastic such as PVC. Alternatively, some or all of frame members 406, rails 408, 408A and purlins 410 may be made as integral pieces from any of metal, plastic and composite material.

In one embodiment of the present invention the various components of pergola system 400 are supplied in kit form with pre-fabricated and pre-cut components. The components may further be provided with openings for the insertion of hardware, for further ease of assembly. Such a pergola system is easily installed by the average homeowner.

While this invention has been shown and described with respect to a detailed embodiment thereof, it will be understood by those skilled in the art that changes in form and detail thereof may be made without departing from the scope of the claims of the invention.

What is claimed is:

1. A pergola system, comprising:

a frame having a plurality of generally vertically-oriented, spaced-apart posts aligned in rows;

a pair of spaced-apart, generally horizontally-oriented frame members attached to each row of posts, each pair of frame members being attached to opposing sides of the posts in a row;

the frame members further including a frame structural member disposed within, the frame structural member including an I-beam running generally parallel to a longitudinal axis of the frame members;

a pair of spaced-apart, generally horizontally-oriented outer rails extending generally orthogonally across the frame members, the outer rails being attached to opposing sides of a post of each row;

the outer rails and a plurality of rails extending generally orthogonally across the frame members, the rails and outer rails being attached to the frame members with a bracket proximate each opposing end of the rails and the outer rails; and the bracket including a pair of spaced-apart tabs and a pair of opposing flanges extending outwardly therefrom, the flanges bring configured for attachment to the frame members, the pair of tabs being configured for receiving and securing the rail or the outer rail, the pergola system being freestanding.

2. The pergola system of claim 1 wherein an exterior surface of each of the posts, frame members, rails and outer rails is a plastic material.

3. The pergola system of claim 1 wherein the posts further comprise:

a support member made from treated lumber; and a hollow sleeve covering the support member, the hollow sleeve being a plastic material.

4. The pergola system of claim 3, further including a post bracket having a generally vertical angular brace configured to support and secure the support member on at least one side.

5. The pergola system of claim 1 further wherein the pair of spaced-apart tabs of the bracket include a first end and a second end, the bracket flanges including a pair of first and second opposing flanges, the first flange extending outwardly from the first end and the second flange extending outwardly from the second end, the first flange and the second flange each being configured for attachment to one of the pair of spaced-apart frame members to allow the bracket to span between and attach to both of the spaced-apart frame members.

6. The pergola system of claim 1 wherein the I-beam includes a generally horizontally-oriented reinforcing rib cantilevered and extending from a vertical portion of the I-beam.

7. The pergola system of claim 1, further including a plurality of purlins extending generally orthogonally across the rails and the outer rails, the purlins being attached to the rails and outer rails.

8. A pergola system, comprising:

a frame having a plurality of generally vertically-oriented, spaced-apart posts aligned in a row;

a pair of spaced-apart, generally horizontally-oriented frame members attached to opposing sides of the row of posts;

the frame members further including a frame structural member disposed within, the frame structural member including an I-beam running generally parallel to a longitudinal axis of the frame members;

a pair of spaced-apart, generally horizontally-oriented outer rails attached to opposing sides of each post, the outer rails extending generally orthogonally across the frame members;

a plurality of rails and outer rails extending generally orthogonally across the frame members, the rails and the outer rails being attached to the frame members with a bracket proximate a first end of each rail and outer rail;

the bracket including a pair of spaced-apart tabs and a pair of opposing flanges extending outwardly therefrom, the flanges being configured for attachment to the frame members, the pair of tabs being configured for receiving and securing the rail or outer rail; and a building structure attachment bracket attached to a second, opposing end of each outer rail and rail, the pergola system being attachable to a building structure with the building structure attachment brackets.

9. The pergola system of claim 8 wherein an exterior surface of each of the posts, frame members, rails, and outer rails is a plastic material.

10. The pergola system of claim 8 wherein the posts further comprise:

a support member made from treated lumber; and a hollow sleeve covering the support member, the hollow sleeve being a plastic material.

11. The pergola system of claim 8, further including a plurality of purlins extending generally orthogonally across the outer rails and the rails, the purlins being attached to the rails.

12. A pergola system, comprising:

a frame having a plurality of generally vertically-oriented, spaced-apart posts aligned in rows;

a pair of spaced-apart, generally horizontally-oriented frame members attached to each row of posts, each pair of frame members being attached to opposing sides of the posts in a row;

a pair of spaced-apart, generally horizontally-oriented outer rails extending generally orthogonally across the frame members, the outer rails being attached to opposing sides of a post of each row;

the outer rails and a plurality of rails extending generally orthogonally across the frame members, the rails and outer rails being attached to the frame members with a bracket proximate each opposing end of the rails and the outer rails;

the bracket including a pair of spaced-apart tabs and a pair of opposing flanges extending outwardly therefrom, the flanges bring configured for attachment to the frame members, the pair of tabs being configured for receiving and securing the rail or the outer rail; and the pair of spaced-apart tabs of the bracket including a first end and a second end, the bracket flanges further including a pair of first and second opposing flanges, the first flange extending outwardly from the first end and the second flange extending outwardly from the second end, the first flange and the second flange each being configured for attachment to one of the pair of spaced-apart frame members to allow the bracket to span between and attach to both of the spaced-apart frame members, the pergola system being freestanding.

13. A pergola system, comprising:

a frame having a plurality of generally vertically-oriented, spaced-apart posts aligned in a row;

a pair of spaced-apart, generally horizontally-oriented frame members attached to opposing sides of the row of posts;

a pair of spaced-apart, generally horizontally-oriented outer rails attached to opposing sides of each post, the outer rails extending generally orthogonally across the frame members;

a plurality of rails and outer rails extending generally orthogonally across the frame members, the rails and the outer rails being attached to the frame members with a bracket proximate a first end of each rail and outer rail;

the bracket including a pair of spaced-apart tabs and a pair of opposing flanges extending outwardly therefrom, the flanges being configured for attachment to the frame members, the pair of tabs being configured for receiving and securing the rail or outer rail;

the pair of spaced-apart tabs of the bracket including a first end and a second end, the bracket flanges further including a pair of first and second opposing flanges, the first flange extending outwardly from the first end and the second flange extending outwardly from the second end, the first flange and the second flange each being configured for attachment to one of the pair of spaced-apart frame members to allow the bracket to span between and attach to both of the spaced-apart frame members; and a building structure attachment bracket attached to a second, opposing end of each outer rail and rail, the pergola system being attachable to a building structure with the building structure attachment brackets.

* * * * *